US012745857B2

(12) United States Patent
Hu et al.

(10) Patent No.: US 12,745,857 B2
(45) Date of Patent: Sep. 29, 2026

(54) CRIB

(71) Applicant: Wonderland Switzerland AG, Steinhausen (CH)

(72) Inventors: Junjie Hu, Dongguan (CN); Tao Wang, Dongguan (CN)

(73) Assignee: WONDERLAND SWITZERLAND AG, Steinhausen (CH)

( * ) Notice: Subject to any disclaimer, the term of this patent is extended or adjusted under 35 U.S.C. 154(b) by 35 days.

(21) Appl. No.: 18/729,649

(22) PCT Filed: Jan. 18, 2023

(86) PCT No.: PCT/EP2023/051093
§ 371 (c)(1),
(2) Date: Jul. 17, 2024

(87) PCT Pub. No.: WO2023/139102
PCT Pub. Date: Jul. 27, 2023

(65) Prior Publication Data

US 2025/0089910 A1 Mar. 20, 2025

(30) Foreign Application Priority Data

Jan. 18, 2022 (CN) ..... 202210055066.5

(51) Int. Cl.
*A47D 9/00* (2006.01)
*A47D 9/02* (2006.01)

(52) U.S. Cl.
CPC ..... *A47D 9/012* (2022.08); *A47D 9/02* (2013.01); *A47D 9/016* (2022.08)

(58) Field of Classification Search
CPC . A47D 9/012; A47D 9/09; A47D 9/00; A47D 9/02; A47D 9/04; A47D 9/016
(Continued)

(56) References Cited

U.S. PATENT DOCUMENTS 10,694,866 B2 6/2020 Gallina
2001/0044958 A1 11/2001 Deangelo
(Continued)

FOREIGN PATENT DOCUMENTS

CN 202950347 U 5/2013
CN 104523075 A 4/2015
(Continued)

OTHER PUBLICATIONS

CN 1st Office Action with English Translation; CN Appl No. 202210055066.5; Date Mailed: Jun. 17, 2025; pp. 1-31.
(Continued)

*Primary Examiner* — David R Hare
*Assistant Examiner* — Joseane E. Tejada
(74) *Attorney, Agent, or Firm* — CANTOR COLBURN LLP

(57) ABSTRACT

The present disclosure relates to a crib, which includes a body, a bed frame and a support base. The body has an accommodation space configured to accommodate a child and includes a slide rod. The bed frame is configured to support the body. The support base is fixed to the bed frame and the slide rod extends through the support base and is slidable relative to the support base. The crib is configured for a child to sleep or play, can function as a cradle which facilitates calming the child, has a simple structure and is easy to operate.

19 Claims, 35 Drawing Sheets

(58) Field of Classification Search
USPC ..... 5/931
See application file for complete search history.

(56) References Cited

U.S. PATENT DOCUMENTS

| | | | |
|---|---|---|---|
| 2012/0017369 | A1 | 1/2012 | Li |
| 2021/0076841 | A1 | 3/2021 | Hu |
| 2021/0076842 | A1 | 3/2021 | Guo et al. |
| 2021/0267385 | A1 | 9/2021 | Gillett et al. |

FOREIGN PATENT DOCUMENTS

| | | | | |
|---|---|---|---|---|
| CN | 204950244 | U | 1/2016 | |
| CN | 103202634 | B | 4/2016 | |
| CN | 108113338 | A | 6/2018 | |
| CN | 108497830 | A | 9/2018 | |
| CN | 208403890 | U | 1/2019 | |
| CN | 209106737 | U | 7/2019 | |
| CN | 112603110 | A | 4/2021 | |
| CN | 214016850 | U | 8/2021 | |
| CN | 215382750 | U | 1/2022 | |
| EP | 2614754 | A1 * | 7/2013 | ..... A47D 9/012 |
| JP | 3214140 | U | 11/2017 | |

OTHER PUBLICATIONS

JP Office Action with English Translation; JP Appl No. 2024542430; Date Mailed: Jul. 2, 2025; pp. 1-8.
KR Office Action with English Translation; KR Appl: 10-2024-7026235; Date Mailed: Nov. 1, 2025; pp. 1-23.
PCT Notification of Transmittal of The International Search Report and The Written Opinion of the International Searching Authority, or the Declaration; International Application No. PCT/EP2023/051093; International Filing Date: Jan. 18, 2023; Date of Mailing: Mar. 27, 2023; pp. 1-10.
TW OA with English Translation, Application No. 112102451; Date Mailed: Dec. 12, 2023; pp. 1-28.
CN NOA with English Translation; CN Appl No. 202210055066.5; Date Mailed: May 1, 2026; pp. 1-5.

* cited by examiner

CRIB

CROSS REFERENCE TO RELATED APPLICATIONS

This application is a National Stage Application of PCT/EP2023/051093, filed Jan. 18, 2023, which claims priority to Chinese Patent Application No. 202210055066.5, filed on Jan. 18, 2022, the entire contents of which are incorporated herein in their entirety.

TECHNICAL FIELD

The present disclosure relates to the technical field of baby carriers, and in particular, to a crib.

BACKGROUND

Conventional cribs are configured for a child to sleep or play, which is single functioned and can not achieve the role of calming the child. Although there are some cribs with cradle function on the market, but the structure is complex, the operation is cumbersome, which is not convenient for the caregiver to take care of the child.

SUMMARY

Accordingly, it is necessary to provide a crib for a child to sleep or play, can function as a cradle which facilitates calming the child, has a simple structure and is easy to operate.

An aspect of the present disclosure provides a crib, which includes a body, a bed frame and a support base.

The body has an accommodation space configured to accommodate a child and includes a slide rod.

The bed frame is configured to support the body.

The support base is fixed to the bed frame. The slide rod extends through the support base and is slidable relative to the support base.

In the crib, the body has an accommodation space for a child to sleep or play in the body. The body is supported by the bed frame, and the body extends through the support base by a slide rod, so as to realize a slide connection between the slide rod and the support base, that is, a slide connection between the body and the support base. In this way, the swing of the body relative to the bed frame can be realized by pushing and pulling the basket back and forth. The crib has a simple structure to realize the swing function of the body, and it is easy to operate.

In one of the embodiments, the crib further includes a locking mechanism. The body is fixed relative to the support base when the locking mechanism is in a locked state, and the body is slidable relative to the support base when the locking mechanism is in an unlocked state.

In one of the embodiments, the locking mechanism includes a first locking portion disposed on the slide rod and a second locking portion disposed on the support base. The second locking portion is operatable to be engaged with or disengaged from the first locking portion, such that the locking mechanism is in the locked state or the unlocked state.

In one of the embodiments, the support base has a through passage. The slide rod extends through the through passage. The first locking portion is a locking hole disposed on the slide rod, and the second locking portion is a locking pin disposed on the support base that can be inserted into the locking hole.

In one of the embodiments, the locking mechanism further includes an elastic member that constantly moves the locking pin in a direction toward the locking hole.

In one of the embodiments, the locking mechanism further includes an operating member operatable to move the locking pin in a direction toward or away from the locking hole.

In one of the embodiments, the operating member is a knob provided with a driving rib. The support base is provided with a driving inclined surface cooperating with the driving rib, and the knob is rotatable such that the driving rib moves along the driving inclined surface to move the locking pin in a direction toward or away from the locking hole.

In one of the embodiments, the driving inclined surface is provided with a first stop position and a second stop position. The locking pin is disengaged from the locking hole when the driving rib is moved to the first stop position; the locking pin is inserted into and engaged with the locking hole when the driving rib is moved to the second stop position.

In one of the embodiments, the support base is provided with a first mounting protrusion provided with a first mounting hole in communication with the locking hole. The locking pin movably extends through the first mounting hole. The driving inclined surface is provided in a side wall of the first mounting protrusion. The knob has a first mounting groove. The driving rib is disposed on a side wall of the first mounting groove. The knob is rotatably disposed on the first mounting protrusion such that all or part of the first mounting protrusion is accommodated in the first mounting groove, and a bottom wall of the first mounting groove is connected to an end of the locking pin away from the locking hole.

In one of the embodiments, the locking mechanism further includes an elastic member. The locking pin is provided with an abutting flange, and two ends of the elastic member abut on the abutting flange and the bottom wall of the first mounting groove respectively.

In one of the embodiments, the operating member is a button having a first pressing end and a second pressing end. The locking pin is capable of being inserted into and engaged with the locking hole when the first pressing end is pressed, and the locking pin is capable of being disengaged from the locking hole when the second pressing end is pressed.

In one of the embodiments, the support base is provided with a mounting base. The button is movably disposed on the mounting base. An end of the locking pin away from the locking hole is connected to the first pressing end. When the first pressing end is pressed, the first pressing end is moved in a direction toward the locking hole and the second pressing end is moved in a direction away from the locking hole; when the second pressing end is pressed, the second pressing end is moved in a direction toward the locking hole and the first pressing end is moved in a direction away from the locking hole.

In one of the embodiments, the mounting base is provided with a first engaging portion. A side of the button close to the second pressing end is provided with a second engaging portion. The second engaging portion is engaged with the first engaging portion when the second pressing end is pressed, and the second engaging portion is disengaged from the first engaging portion when the first pressing end is pressed.

In one of the embodiments, the first engaging portion is an engaging hole, and the second engaging portion is an engaging finger. An engaging hook is disposed on the engaging finger. The engaging hook is inserted into the engaging hole when the second pressing end is pressed, and the engaging hook is disengaged from the engaging hole when the first pressing end is pressed.

In one of the embodiments, the locking mechanism further includes an elastic member. The locking pin is provided with an abutting flange. The mounting base is provided with a second mounting protrusion. The second mounting protrusion has a receiving groove in communication with the through passage. The second mounting protrusion is provided with a second mounting hole in communication with the receiving groove. The locking pin movably extends through the second mounting hole, and two ends of the elastic member abut on the abutting flange and the bottom wall of the receiving groove respectively.

In one of the embodiments, the button has a second mounting groove. The locking pin is partially disposed in the second mounting groove. A guide post is disposed on a groove wall of the second mounting groove. A guide slot having a long-bar shape is disposed on the locking pin in an extension direction of the locking pin, and the guide post is inserted into the guide slot such that the locking pin can be moved relative to the button.

In one of the embodiments, the locking mechanism further includes a pressing member. The pressing member has a unlocked position and a locked position. The locking pin is capable of being inserted into and engaged with the locking hole when the pressing member is in the locked position, and the locking pin is capable of being disengaged from the locking hole when the pressing member is in the unlocked position. The pressing member is capable of being pressed to switch between the locked position and the unlocked position.

In one of the embodiments, an assembly groove in communication with the through passage is disposed on the support base. The pressing member is movably disposed in the assembly groove. The pressing member has a pressing portion at least partially protruding from the support base. The locking pin is fixed to the pressing member, and a pressing direction of the pressing portion is staggered with an extension direction of the locking pin.

In one of the embodiments, the locking mechanism further includes an elastic member that constantly moves the locking pin toward the unlocked position.

In one of the embodiments, a base is provided in the support base. An abutting protrusion is provided at an end of the pressing member away from the pressing portion, and two ends of the elastic member abut on the base and the abutting protrusion respectively.

In one of the embodiments, the locking mechanism further includes a holding assembly configured to hold the pressing member in the locked position when the pressing member is in the locked position.

In one of the embodiments, the holding assembly includes a holding frame and a holding member. The holding frame is rotatably connected to the base, and an end of the holding frame away from the base is a snap portion. The holding member is fixed to the pressing member. The holding member includes a holding body and a limit block fixed to the holding body. A side of the limit block close to the pressing portion has a first limit projection and a second limit projection. The first limit projection and the second limit projection enclose a limit slot. The limit block and the holding body enclose a guide passage in communication with the limit slot. The snap portion is movable along the guide passage. The snap portion is moved along the guide passage and projects into the limit slot by passing the first limit projection when the pressing member is moved from the unlocked position to the locked position, and the snap portion is moved along the guide passage and disengaged from the limit slot by passing the second limit projection when the pressing member is moved from the locked position to the unlocked position.

In one of the embodiments, the support base is further provided with a roller abutting on the slide rod.

In one of the embodiments, there are at least two rollers, and at least two opposite sides of the slide rod abut on the rollers.

In one of the embodiments, the slide rod is a straight rod.

In one of the embodiments, the slide rod is an arc rod.

In one of the embodiments, the arc rod depresses in a direction toward the ground.

In one of the embodiments, both opposite sides of the body are provided with the slide rod. The bed frame includes support posts on opposite sides of the bed frame. Both the support posts are fixed to two said support bases respectively, and the slide rods on the opposite sides of the body extend through the support bases on the opposite sides of the bed frame respectively.

In one of the embodiments, the support post is height adjustable.

In one of the embodiments, the support post includes a first socket rod, a second socket rod and a height adjustment handle. The first socket rod is partially inserted into the second socket rod, and the height adjustment handle is operatable such that the first socket rod is fixed or slidable relative to the second socket rod.

DESCRIPTION OF THE ACCOMPANYING DRAWINGS

100—body, 110—support rod, 110*a*—slide rod, 200—bed frame, 210—support post, 211—pillar, 2111—first socket rod, 2112—second socket rod, 2113—height adjustment handle, 2114—adjustment hole, 2115—adjustment pin, 2116—connecting member, 2117—reset member, 212—support bracket, 300—support base, 310—support body, 311—through passage, 312—roller, 313—first mounting protrusion, 313*a*—first mounting hole, 313*b*—driving inclined surface, 313*c*—first stop position, 313*d*—second stop position, 314—mounting base, 314*a*—snap hole, 314*b*—second mounting protrusion, 314*c*—receiving groove, 314*d*—second mounting hole, 315—assembly groove, 316—base, 400—locking mechanism, 410—elastic member, 420—locking hole, 430—locking pin, 431—abutting flange, 432—guide slot, 440—knob, 441—rotation projection, 442—first mounting groove, 443—driving rib, 450—button, 451—pressing surface, 451*a*—first pressing end, 451*b*—second pressing end, 452—second mounting groove, 452*a*—guide post, 453—snap finger, 453*a*—snap hook, 460—pressing member, 461—pressing portion, 462—abutting protrusion, 470—holding assembly, 471—holding frame, 471*a*—snap portion, 472—holding member, 472*a*—holding body, 472*b*—limit block, 472*c*—first limit projection, 472*d*—second limit projection, 472*e*—limit slot, 472*f*—bottom corner, 473—guide passage, 473*a*—first passage, 473*b*—second passage, 473*c*—third passage, 474—receiving passage, 481—blocking projection.

DETAILED DESCRIPTION OF THE EMBODIMENTS

In order to make the object, technical solution and advantages of the present disclosure more clearly understood, the present disclosure is further described in detail with reference to the drawings and specific embodiments below. It should be understood that the specific embodiments described herein serve only to explain the present disclosure and do not limit the scope of protection of the present disclosure.

It is noted that when an element is said to be "fixed" to another element, it may be directly fixed on the other element or an intermediate element may exist. When an element is considered to be "attached" to another element, it can be directly attached to the other element or an intermediate element may exist. The terms "vertical", "horizontal", "left", "right" and similar expressions used herein are for illustrative purposes only, and are not meant to be the only means of implementation.

Unless otherwise defined, all technical and scientific terms used herein have the same meanings as are generally understood by those skilled in the field of the present disclosure. The terms used herein in the description of the present disclosure are used only for the purpose of describing specific embodiments and are not intended to limit the present disclosure. The term "and/or" as used herein includes any and all combinations of one or more of the relevant listed items.

Figure 1:
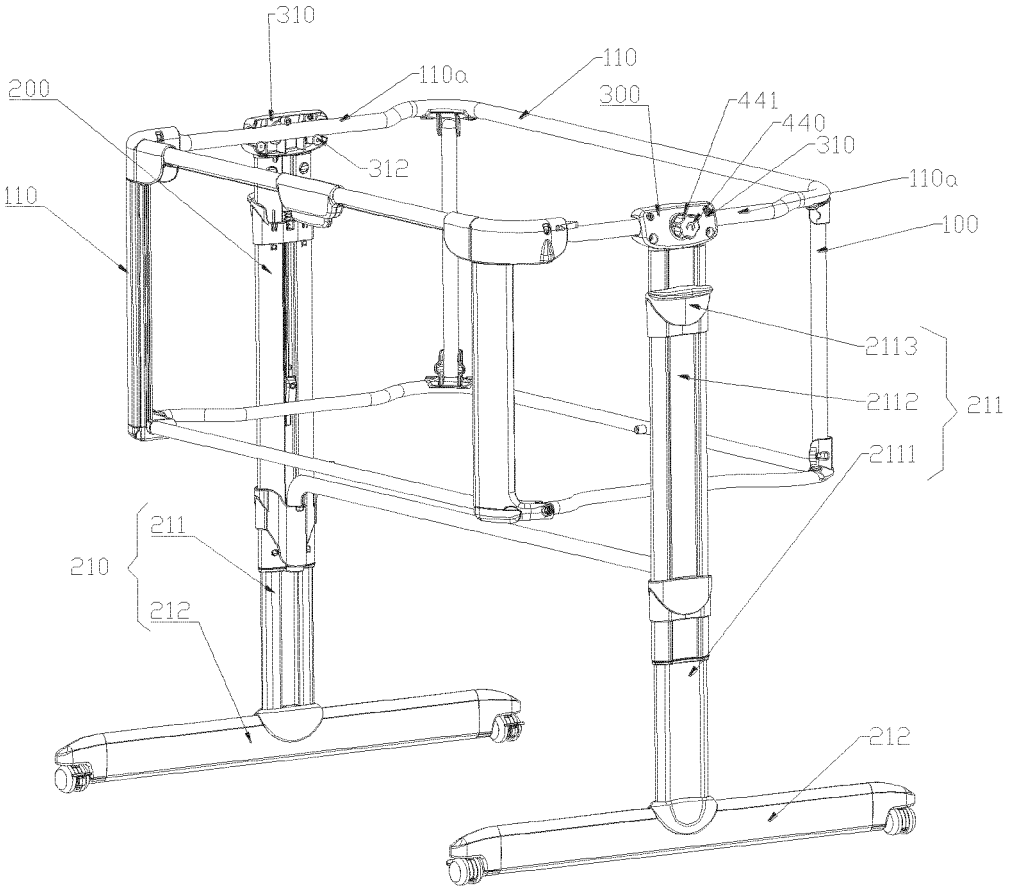
FIG. 1 is a schematic diagram of a crib according to an embodiment of the present disclosure.
Figure 2:
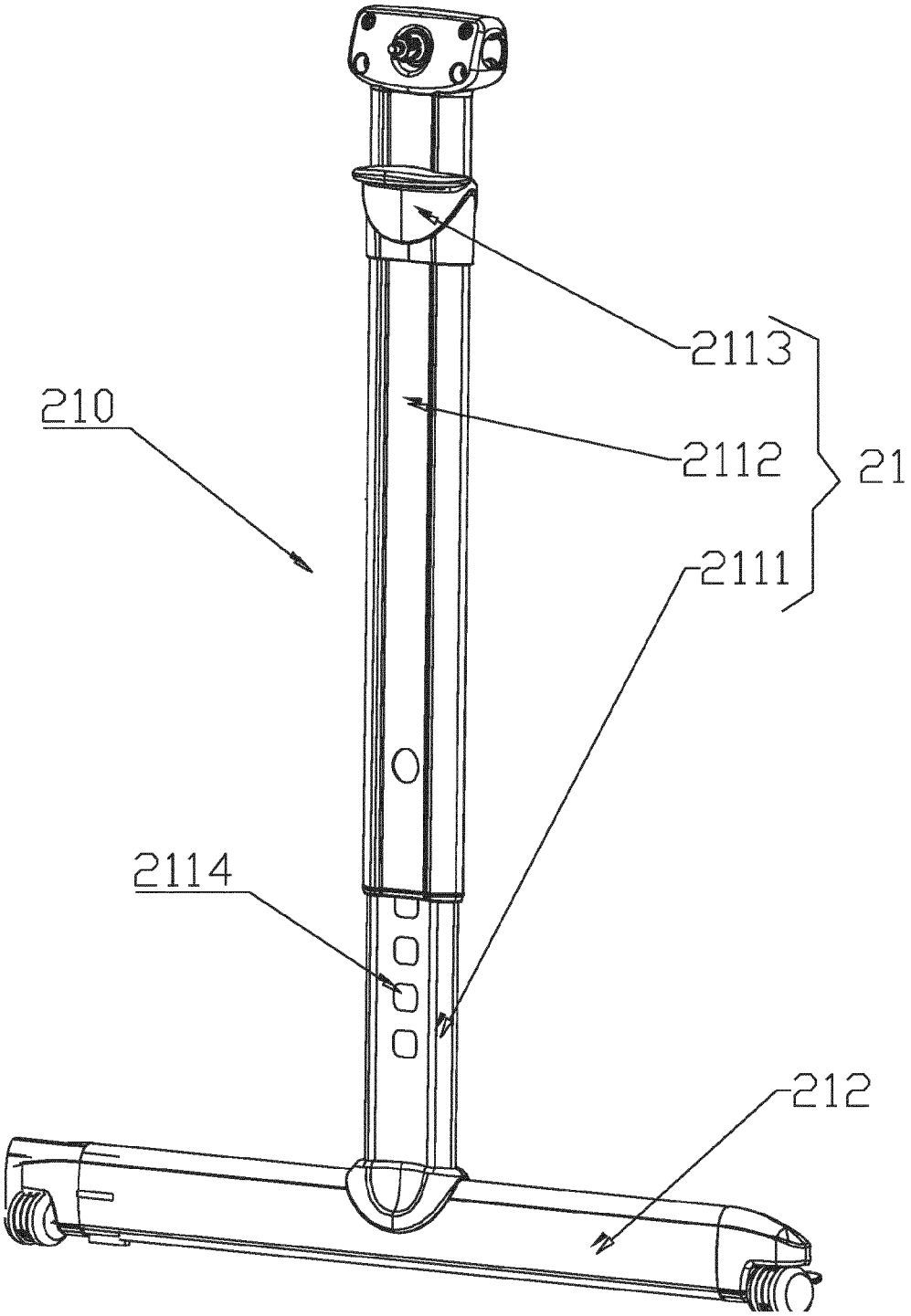
FIG. 2 is a schematic diagram of a support post in the crib shown in FIG. 1.
Figure 3:
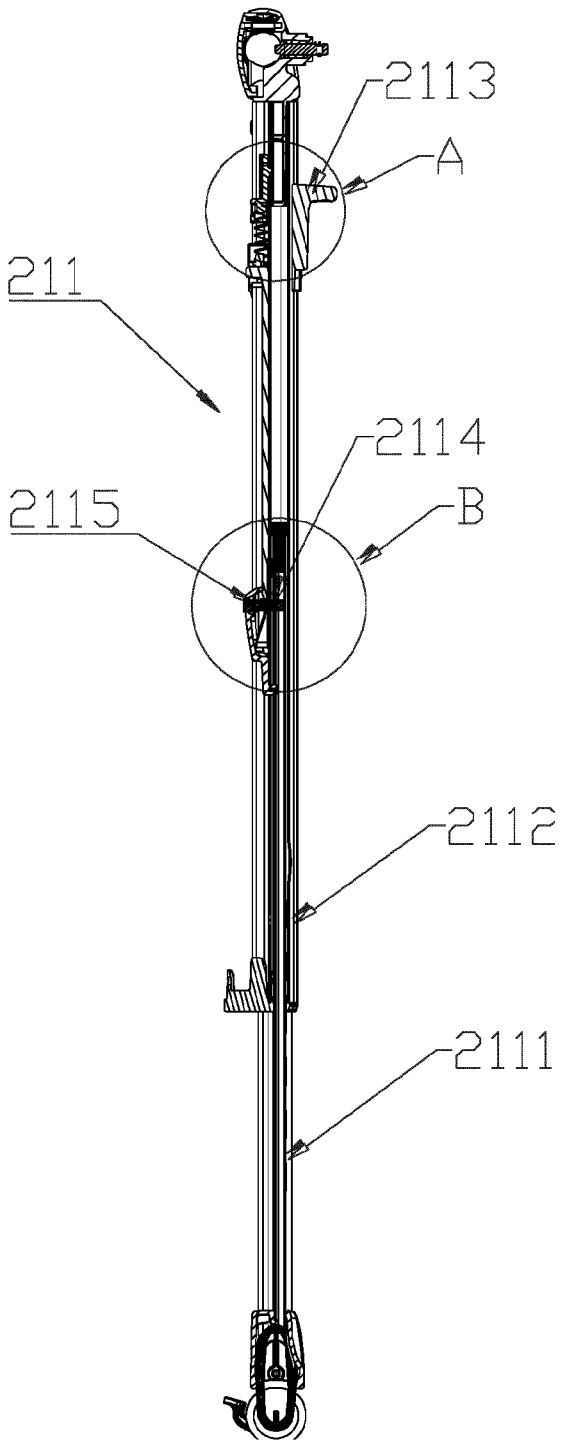
FIG. 3 is a sectional view of a pillar in the crib shown in FIG. 1.
Figure 4:
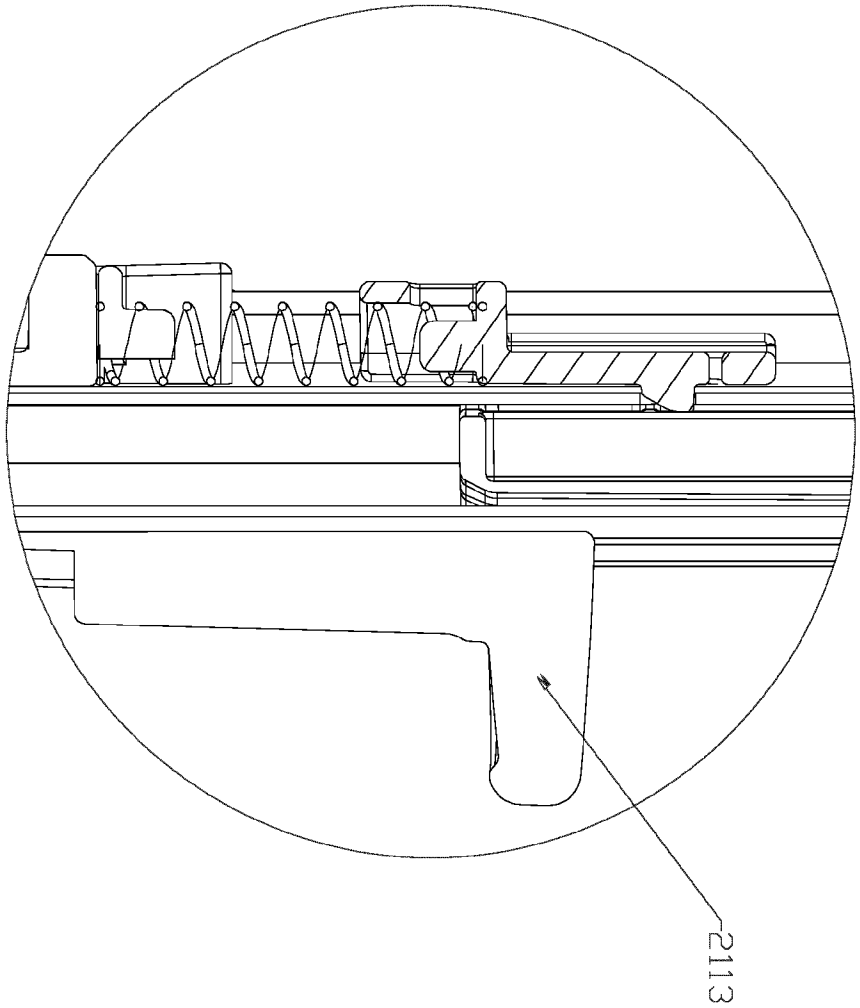
FIG. 4 is an enlarged view of portion A of FIG. 3.
Figure 5:
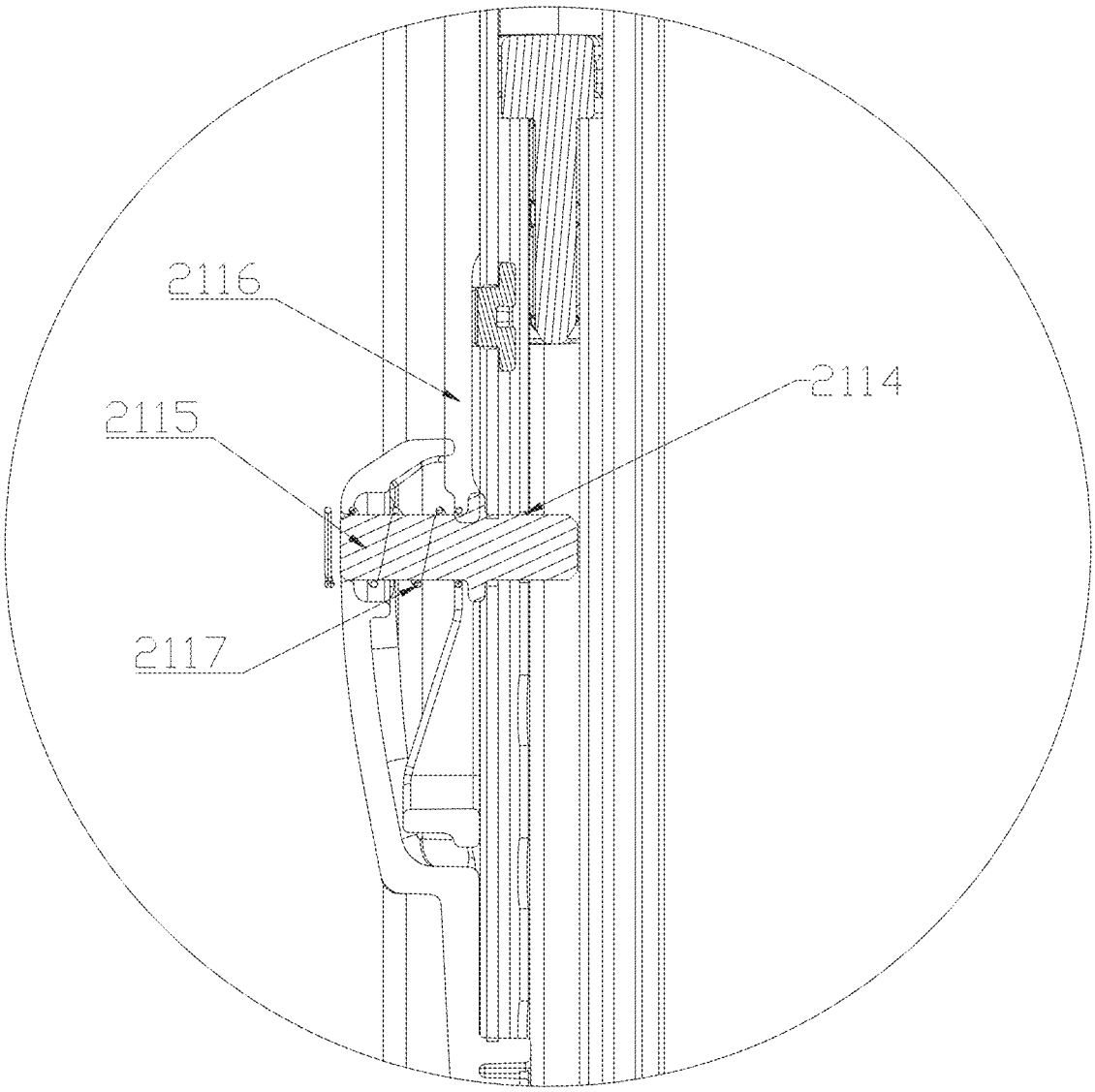
FIG. 5 is an enlarged view of portion B of FIG. 3.
Figure 16:
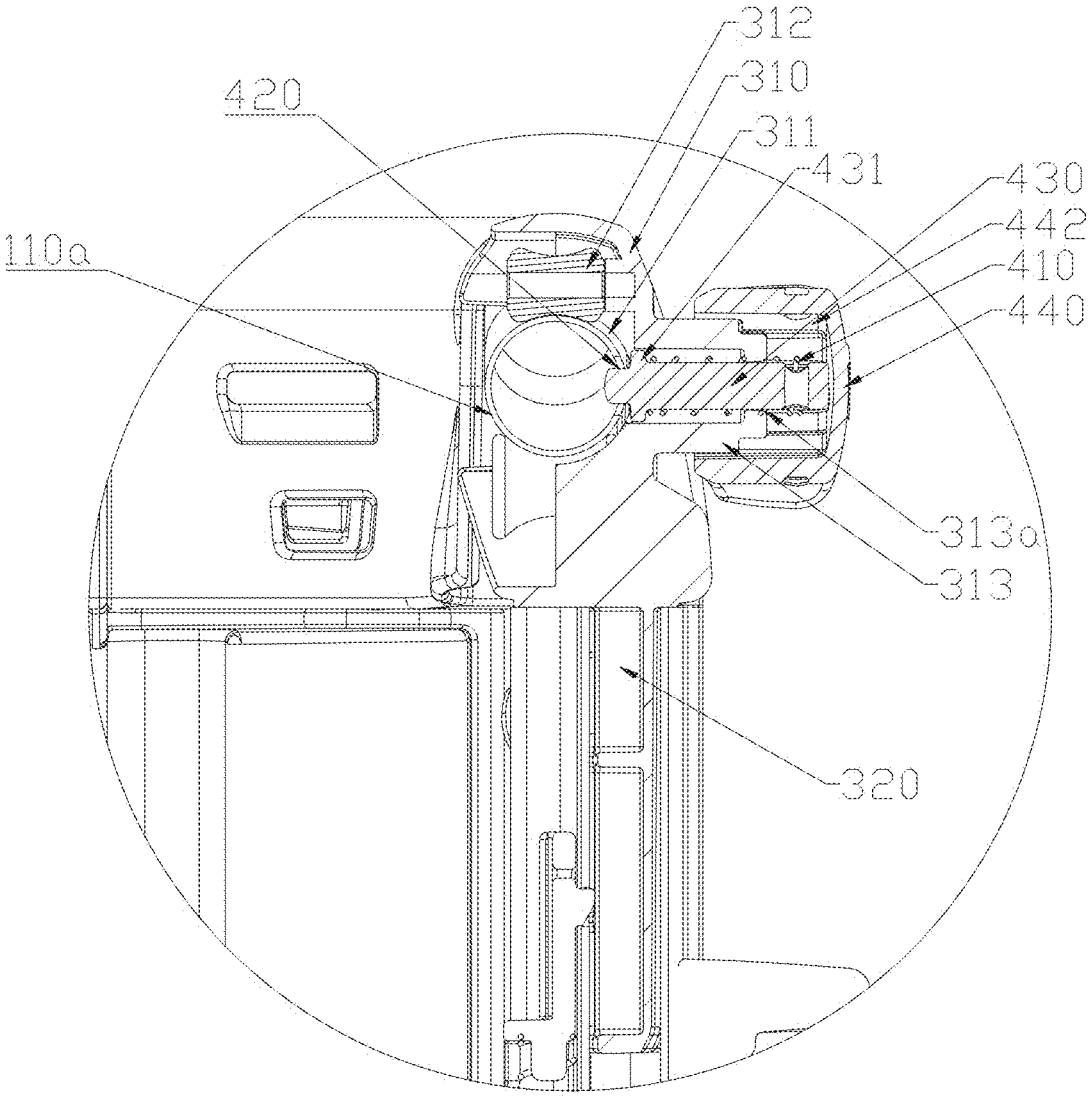
FIG. 16 is an enlarged view of portion D of FIG. 15.

As shown in FIGS. 1 and 16, the present disclosure provides a crib comprising a body 100, a bed frame 200, a support base 300 and a locking mechanism 400. The crib is configured for a child to sleep or play, can function as a cradle which facilitates calming the child, has a simple structure and is easy to operate.

Figure 6:
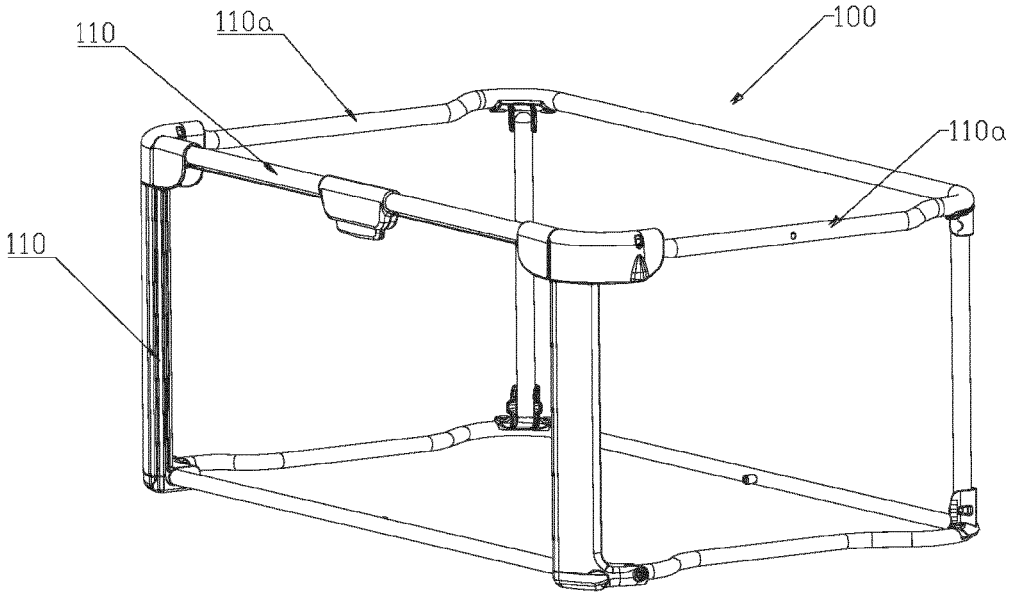
FIG. 6 is a schematic diagram of a body in the crib shown in FIG. 1.
Figure 10:
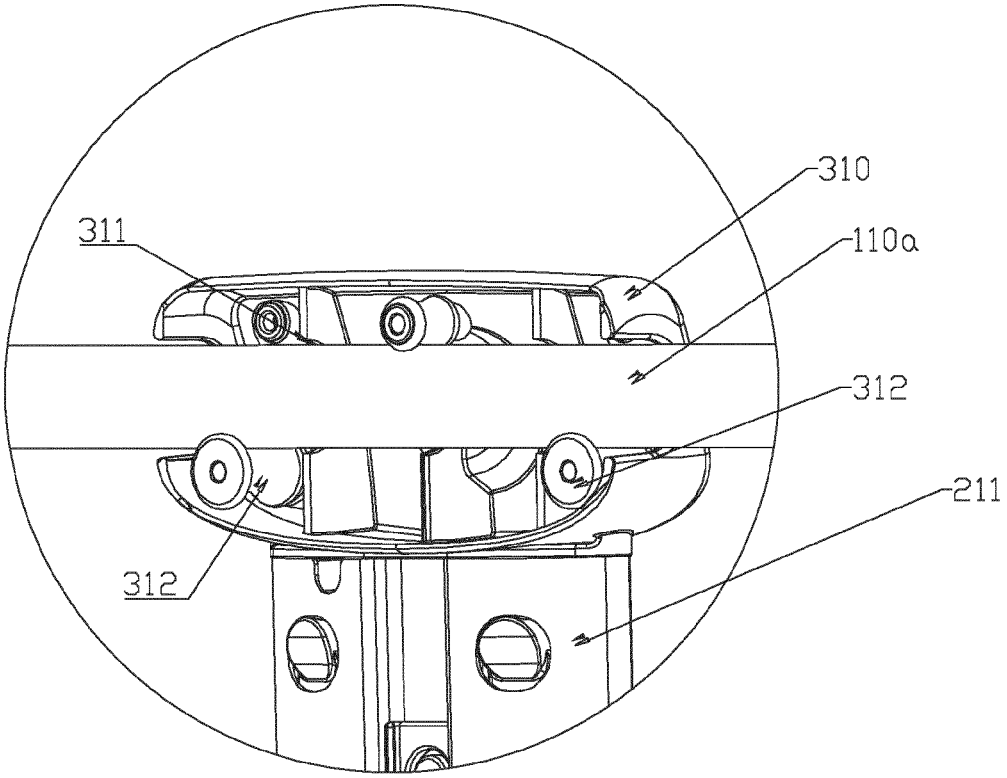
FIG. 10 is a partially enlarged view of FIG. 1 with the slide rod being a straight rod.
Figure 11:
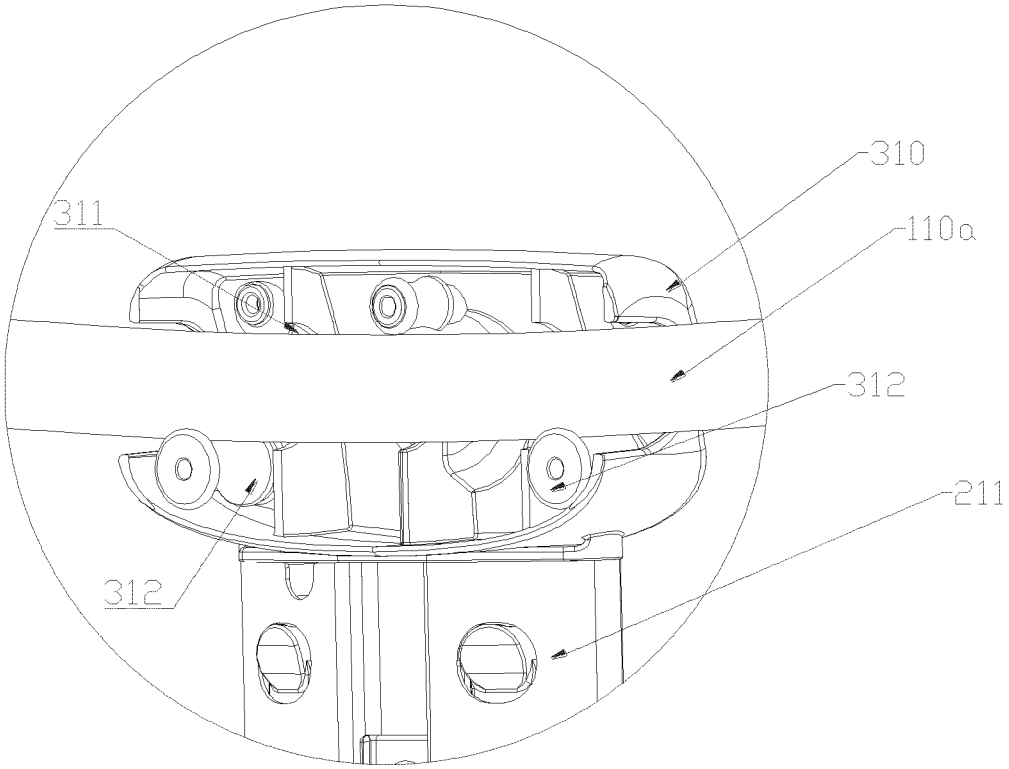
FIG. 11 is a partially enlarged view of FIG. 1 with the slide rod being an arc rod.
Figure 12:
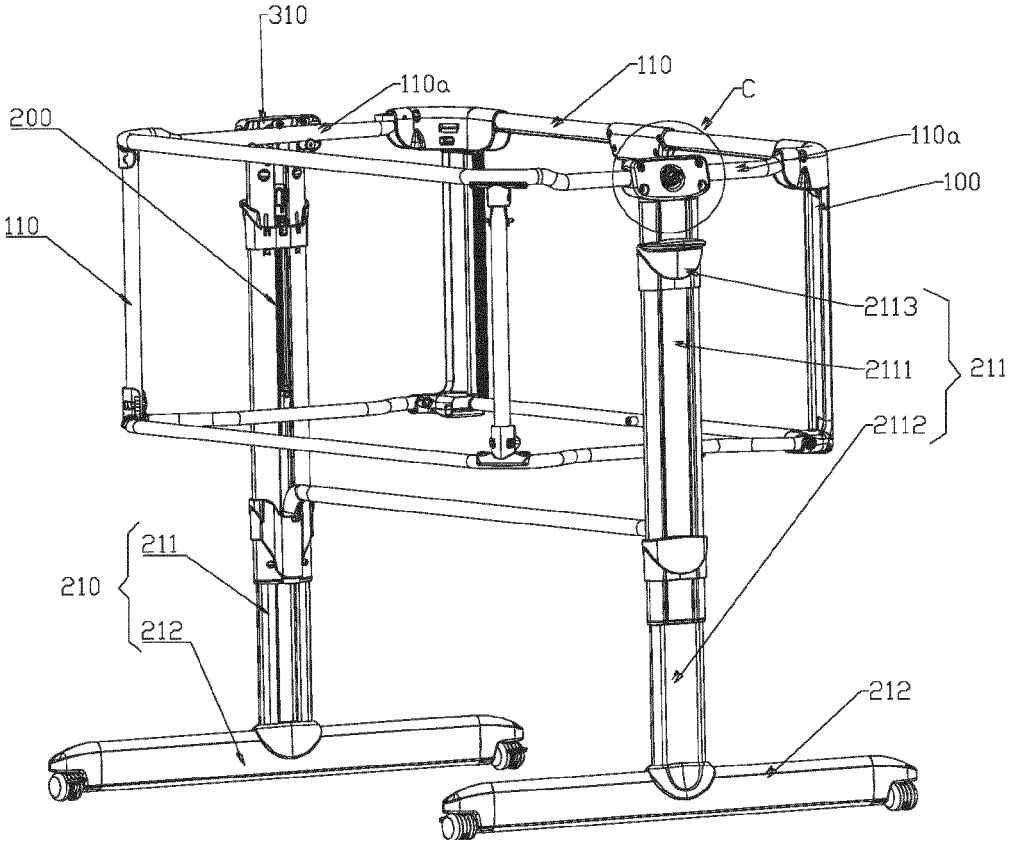
FIG. 12 is a schematic diagram of the crib shown in FIG. 1 omitting a knob.

Specifically, as shown in FIG. 6, the body 100 has a box-like structure approximately having a shape of a rectangular. Of course, the shape of the body 100 is not limited thereto, and may be designed as an elliptical cylinder or other shape as required. The body 100 forms an accommodation space to accommodate a child and configured for the child to sleep, play and so on. In this embodiment, the body 100 has a frame structure having a shape of a rectangular which is composed of multiple support rods 110, that is, a rectangular frame is formed at a top portion of the frame structure. Two support rods 110 located on short sides of the rectangular frame serve as slide rods 110*a*. Of course, it is also possible that other support rods 110 forming the frame structure act as slide rods 110*a*, for example, two support rods 110 located on the long sides of the rectangular frame. In this embodiment, as shown in FIG. 10, the slide rod 110*a* is a straight rod. Of course, in other embodiments, the slide rod 110*a* may also be an arc rod. For example, as shown in FIG. 11, the slide rod 110*a* may be an arc rod bent and depressed in a direction toward the ground. Of course, the slide rod 110*a* may be arc rod or the like bent and depressed in a direction away from the ground, which is not limited here. The frame structure may be encased by fabric (not shown) and support pads (not shown) may be provided at the bottom portion of the frame structure to form a protective barrier for the child.

Specifically, as shown in FIG. 1, the bed frame 200 is configured to support the body 100. In this embodiment, the bed frame 200 includes two support posts 210, which are respectively located on the two short sides of the rectangular frame and are configured to support the two slide rods 110*a* respectively. Of course, in other embodiments, the number and location of the support posts 210 may also be adjusted as needed. The support post 210 includes a pillar 211 and a support bracket 212 which are interconnected. The support bracket 212 is located at a bottom portion of the pillar 211, which substantially forms an inverted "T" shaped structure with the pillar 211. This setting improves the support stability of the support post 210. Of course, the setting of the support post 210 is not limited thereto.

Figure 24:
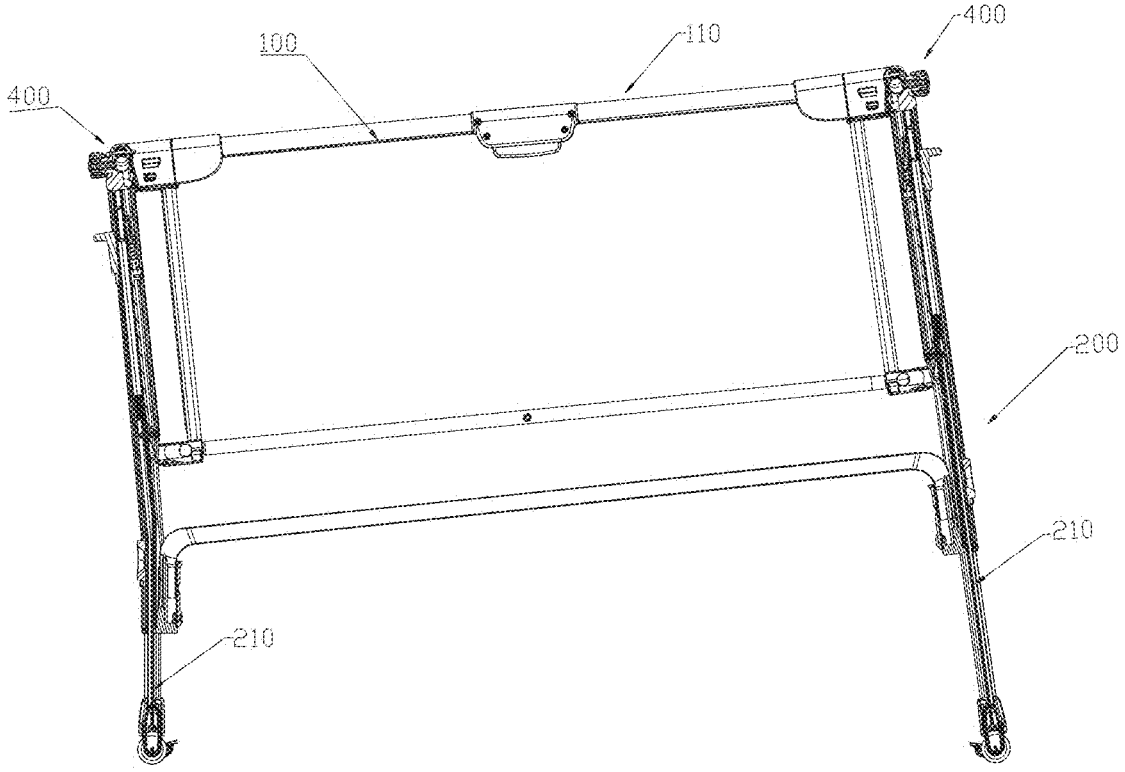
FIG. 24 is a further sectional view of FIG. 1, in which a bottom portion of the body is inclined.

Further, as shown in FIGS. 1 to 5, the height of both support posts 210 is adjustable. The adjustment manner of the height of the support post 210 is not limited, for example, the pillar 211 may include a first socket rod 2111, a second socket rod 2112, and a height adjustment handle 2113. The first socket rod 2111 is partially inserted into the second socket rod 2112, and the first socket rod 2111 is located below the second socket rod 2112. A plurality of adjustment holes 2114 are disposed on the first socket rod 2111 in a height direction, and the height adjustment handle 2113 is sleeved on the second socket rod 2112 and is slidable along the second socket rod 2112. An adjustment pin 2115 is provided on the second socket rod 2112. The adjustment pin 2115 is connected to the height adjustment handle 2113 via a connecting member 2116, and the adjustment pin 2115 can be inserted into or withdrawn from the adjustment hole 2114 by operating the height adjustment handle 2113. When the adjustment pin 2115 is withdrawn from the adjustment hole 2114, the first socket rod 2111 and second socket rod 2112 slide relative to each other to achieve height adjustment of support pillar 210. After adjustment in place, the height adjustment handle 2113 can be operated such that the adjustment pin 2115 is re-inserted into the adjustment hole 2114 under the action of the reset member 2117, thereby the first socket rod 2111 is locked relative to the second socket rod 2112. As required, the height of both support posts 210 can be adjusted simultaneously or the height of only one of the support posts 210 can be adjusted via the height adjustment handle 2113. A bottom portion of the body 100 is horizontal when the height of the two support posts 210 is adjusted simultaneously. When the height of only one of the support posts 210 is adjusted, the bottom portion of the basket 100 is in an inclined state, as shown in FIG. 24. In this way, a plurality of patterns of use can be provided for the child.

Specifically, as shown in FIG. 1, there are two support bases 300, which are fixed at top of the two support posts 210 respectively, that is, on the ends of the two pillars 211 away from the corresponding support brackets 212 respectively. The support base 300 includes a support body 310 and an insertion potion (not shown) which are interconnected. An end of the pillar 211 away from the corresponding support bracket 212 has an insertion groove (not shown) that is engaged with the insertion portion. The insertion portion is inserted into the insertion groove to realize the connection between the support base 300 and the support pillar 210, and the support body 310 is located on an end of the pillar 211 away from the corresponding support bracket 212. Of course, the number, setting position and setting manner of the support base 300 are not limited thereto and can be adjusted according to actual needs.

Further, as shown in FIG. 10 and FIG. 11, the support body 310 has a through passage 311, and the slide rod 110*a* extends through the through passage 311 and is slidable with respect to the support bracket 300 reciprocatingly.

In this way, the swing of the body 100 relative to the bed frame 200 can be realized by pushing and pulling the basket 100 back and forth, which plays a role in calming the child in the body 100, and is simple in structure and convenient in operation. When the slide rod 110*a* is a straight rod, as shown in FIG. 10, reciprocating swing of the body 100 in a horizontal direction can be realized. When the slide rod 110*a* is an arc rod, such as an arc rod depressing in a direction toward the ground, as shown in FIG. 11, it is also possible to realize reciprocating swing of the body 100 in both the horizontal direction and the vertical direction simultaneously.

Further, as shown in FIGS. 10 and 11, a roller 312 is provided in the support base 300 that protrudes into the through passage 311, and the roller 312 abuts on the slide rod 110*a*. In this way, the slide rod 110*a* can be made to slide more smoothly relative to the support bracket 300. In this embodiment, there are four rollers 312, of which two are arranged at intervals on an upper side of the slide rod 110*a* and the other two are arranged at intervals on a lower side of the slide rod 110*a*, such that a better smooth effect can be achieved. Of course, in other embodiments, the number and location of the rollers 312 may also be adjusted as needed.

Specifically, as shown in FIGS. 15 to 18, the locking mechanism 400 includes a first locking portion, a second locking portion, an elastic member 410, and an operating member. When the locking mechanism 400 is in a locked state, the basket 100 is relatively fixed to the support base 300, and when the locking mechanism 400 is in an unlocked state, the body 100 is slidable relative to the support base 300.

Figure 18:
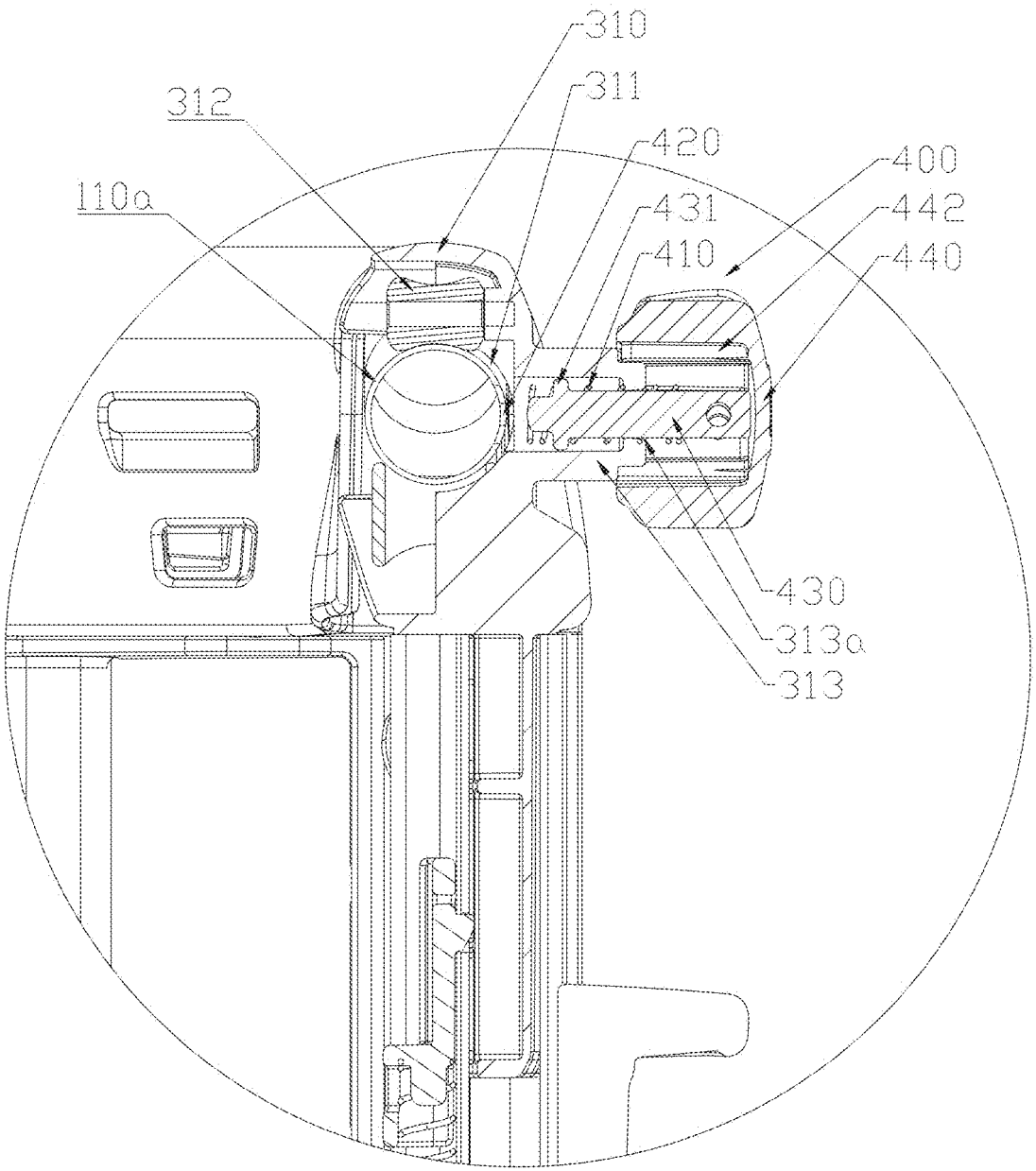
FIG. 18 is an enlarged view of portion E of FIG. 17.

Alternatively, as shown in FIGS. 16 and 18, the first locking portion is a locking hole 420 provided on the slide rod 110*a*, and the second locking portion is a locking pin 430 provided on the support base 300 and insertable into the locking hole 420. The locking pin 430 may be operated to be engaged with or disengaged from the locking hole 420, such that the locking mechanism 400 is in the locked state or the unlocked state. In this embodiment, there is one locking hole 420 which is located approximately in a middle portion of the slide rod 110*a*. Of course, in other embodiments, there may also be a plurality of locking holes 420 disposed in a direction in which the slide rod 110*a* extends such that the basket 100 can be secured to the bed frame 200 in different positions. The locking pin 430 is provided with an abutting flange 431. Of course, in other embodiments, the first locking portion and the second locking portion may also be in other forms, for example, the first locking portion may be a locking groove, and the second locking portion may be a locking projection that is engaged with the locking groove, etc., which is not limited here.

Specifically, the operating member can be in various forms. For example, in one embodiment, as shown in FIGS. 1, and 12 to 14, the operating member may be a knob 440 mounted on the support base 300. The knob 440 has a substantially cylindrical structure and a plurality of rotation projections 441 are disposed on a side wall of the knob 440 to facilitate rotation by the caregiver. The knob 440 is provided with a first mounting groove 442 facing the support base 300, and a driving rib 443 is provided on a side wall of the first mounting groove 442. In this embodiment, there are two driving ribs 443, which are disposed opposite to each other. Of course, in other embodiments, the number and location of the driving ribs 443 may also be adjusted as needed.

Figure 13:
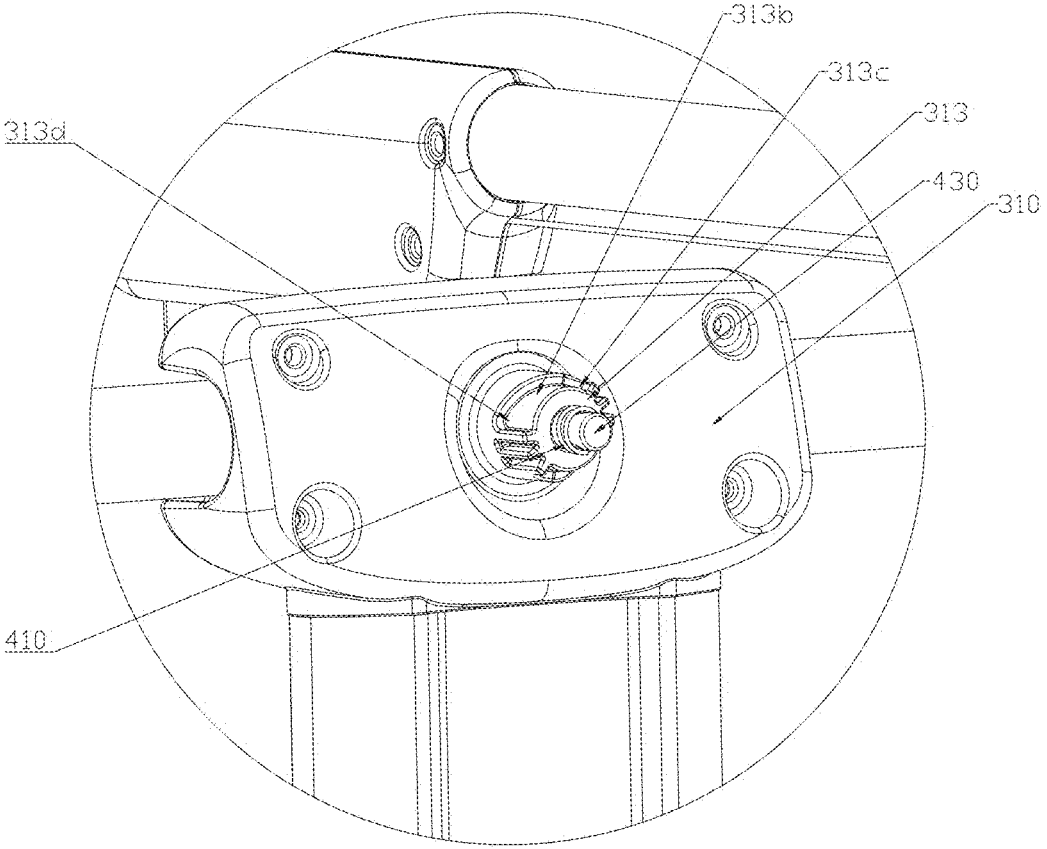
FIG. 13 is an enlarged view of portion C of FIG. 12.
Figure 14:
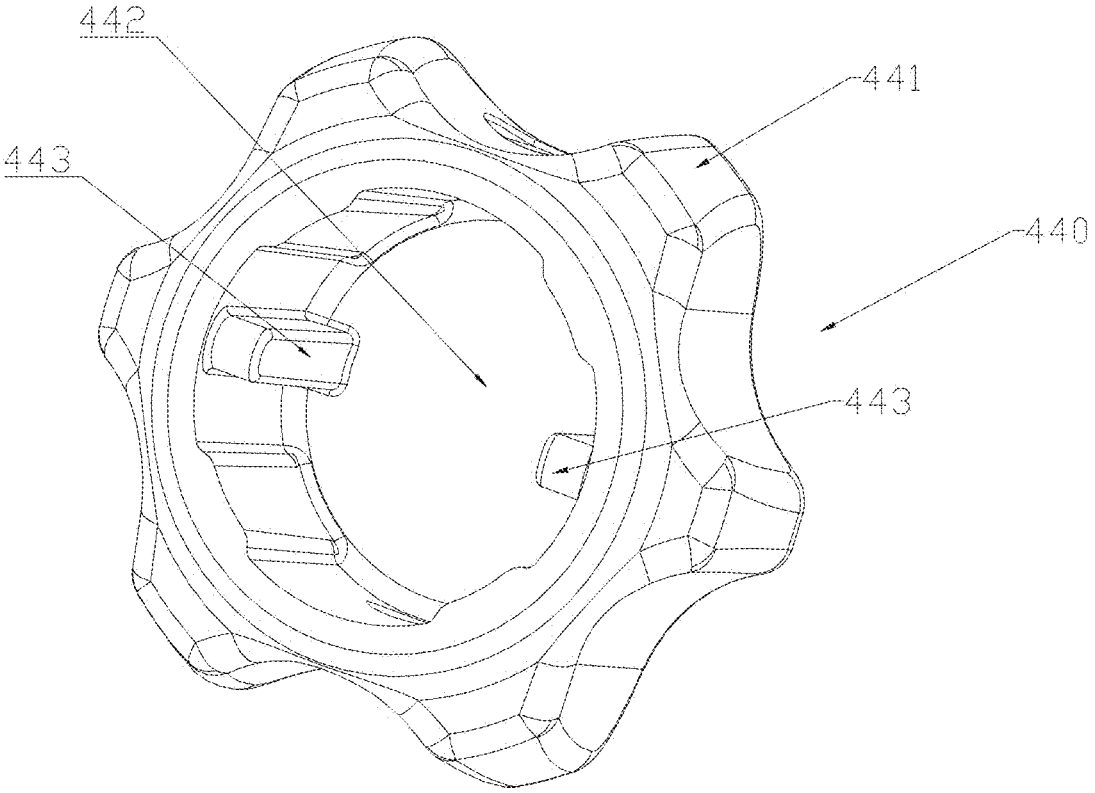
FIG. 14 is a schematic diagram of a knob in the crib shown in FIG. 1.

As shown in FIG. 13, a first mounting protrusion 313 is provided on the support base 300. A first mounting hole 313*a* (see FIGS. 16 and 18) is provided on the middle portion of the first mounting protrusion 313 in communication with the locking hole 420. A locking pin 430 movably extends through the first mounting hole 313*a*, and a driving inclined surface 313*b* cooperating with the driving rib 443 is provided on a side wall of the first mounting protrusion 313. The driving inclined surface 313*b* has a first stop position 313*c* and a second stop position 313*d* at both ends. There are two driving inclined surfaces 313*b* corresponding to the two driving ribs 443. The knob 440 is rotatably disposed on the first mounting protrusion 313 such that the first mounting protrusion 313 is wholly or partially accommodated in the first mounting groove 442, and a bottom wall of the first mounting groove 442 is connected to an end of the locking pin 430 away from the slide rod 110*a*. Specifically, the locking pin 430 is fixed to the bottom wall of the first mounting groove 442 by rivets. In this way, when the knob 440 is rotated, the driving rib 443 is moved along the driving inclined surface 313*b* to move the locking pin 430 in a direction toward or away from the locking hole 420, and the locking pin 430 is disengaged from the locking hole 420 when the driving rib 443 is moved to the first stop position 313*c*. The locking pin 430 is capable of being inserted into the locking hole 420 when the driving rib 443 is moved to the second stop position 313*d*.

Further, as shown in FIGS. 16 and 18, the elastic member 410 is sleeved on the locking pin 430, and two ends of the elastic member 410 abut on the abutting flange 431 and a bottom wall of the first mounting groove 442, respectively. In this way, the elastic member 410 always moves the locking pin 430 in a direction toward the locking hole 420.

A specific operating principle of the locking mechanism 400 according to this embodiment is described as below.

Figure 7:
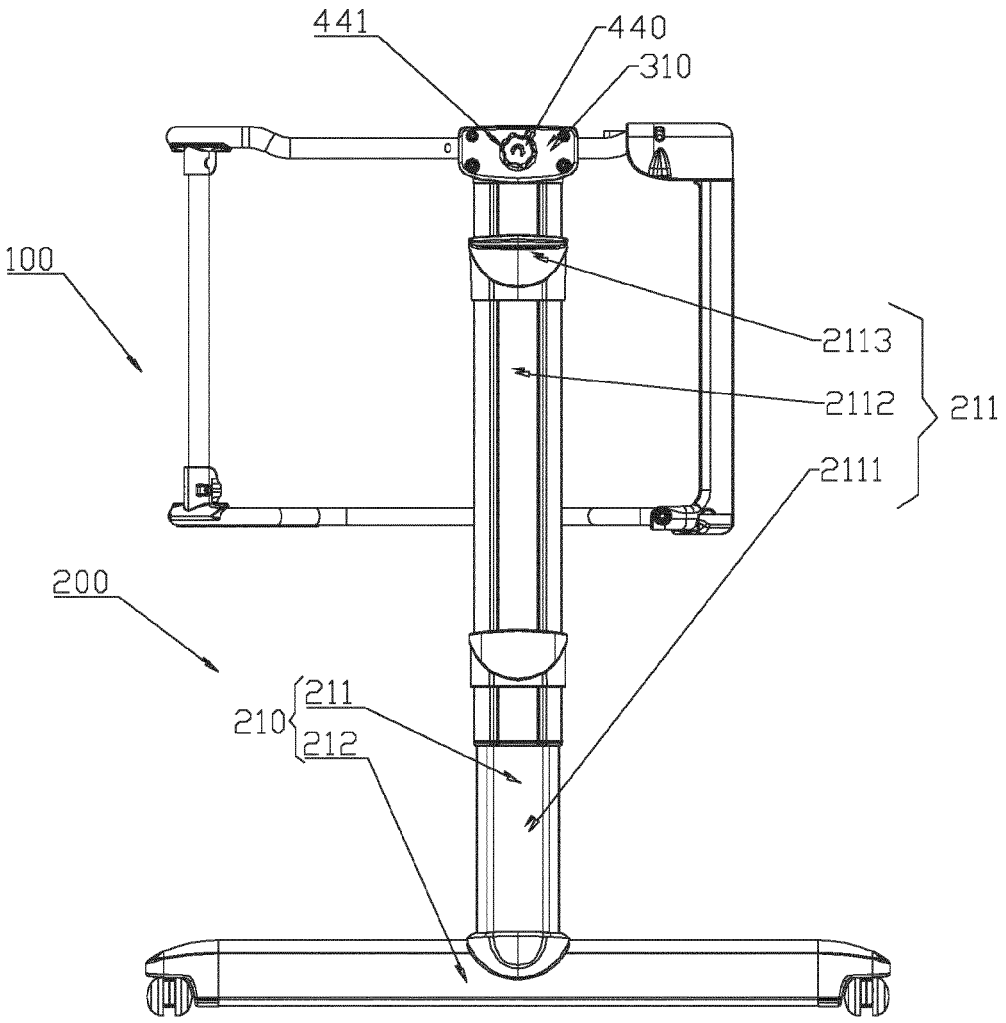
FIG. 7 is a side view of FIG. 1 with the body mainly located on the left side of the bed frame.
Figure 8:
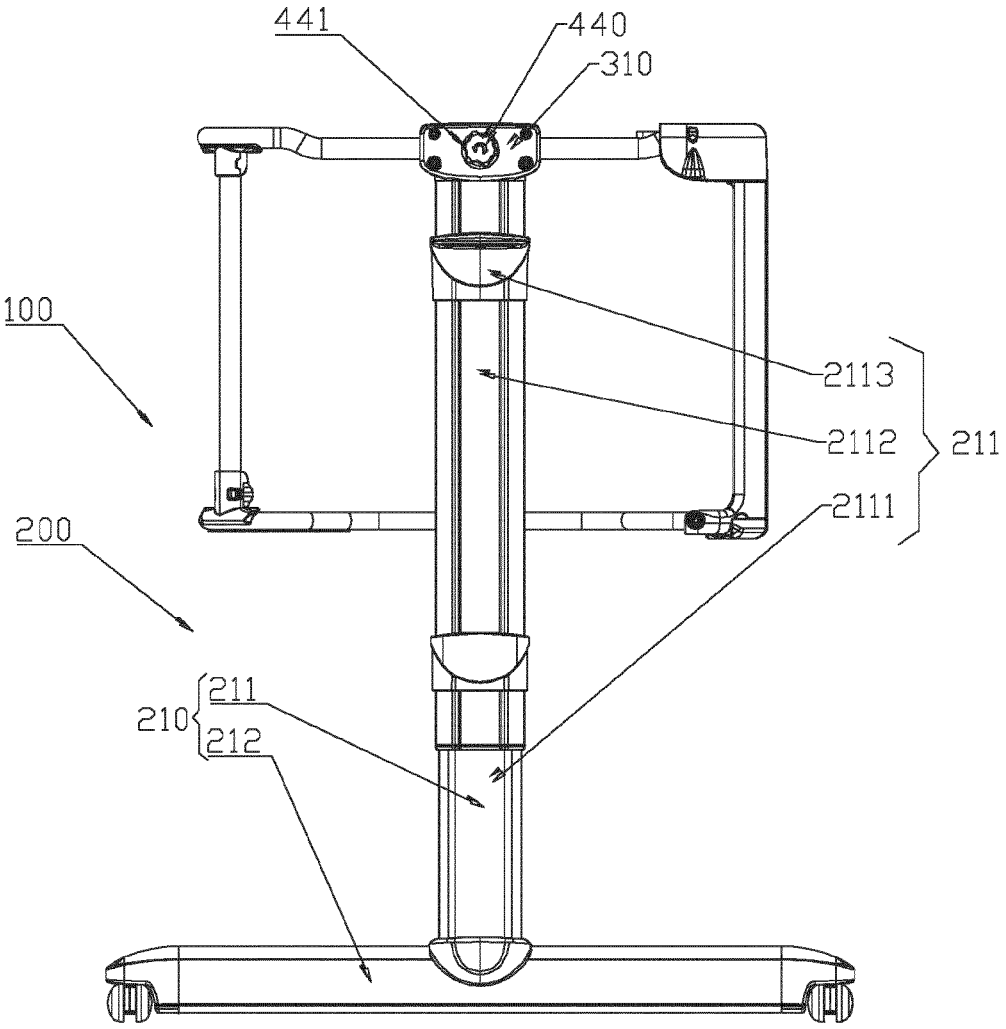
FIG. 8 is another side view of FIG. 1 with the body substantially located in the middle portion of the bed frame.
Figure 9:
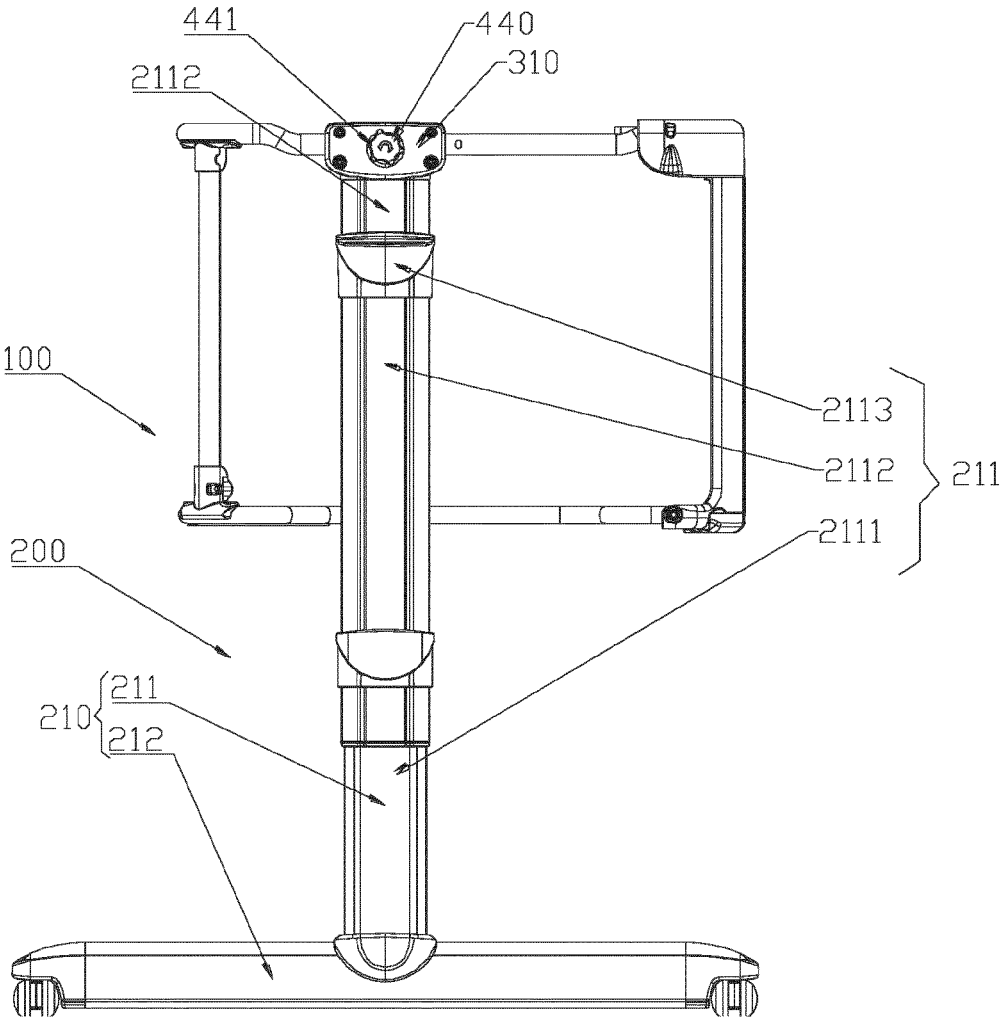
FIG. 9 is a further side view of FIG. 1 with the body mainly located on the right side of the bed frame.

To swing the body 100, rotate the knob 440 such that the driving rib 443 on the knob 440 is moved from the second stop position 313*d* to the first stop position 313*c* along the driving inclined surface 313*b*, and at the same time, the locking pin 430 originally inserted into the locking hole 420 is disengaged from the locking hole 420, as shown in FIG. 16 and FIG. 18. At this time, the locking mechanism 400 is unlocked, the slide rod 110*a* is slidable relative to the support base 300, that is, pushing the body 100 allows the body 100 to swing relative to the bed frame 200, as shown in FIGS. 7 to 9.

If it is necessary to stop the swing of the body 100 and fix it to the bed frame 200, rotate the knob 440 such that the driving rib 443 on the knob 440 is moved from the first stop position 313*c* to the second stop position 313*d* along the driving inclined surface 313*b*. Since the bottom wall of the first mounting groove 442 is gradually close to the locking hole 420, the locking pin 430 abuts on the slide rod 110*a*, and the elastic member 410 is compressed and deformed. At this time, push and pull the body 100 such that the slide rod 110*a* is moved to make the support base 300 approximately on the middle portion of the slide rod 110*a* and the locking hole 420 is aligned with the first mounting hole 313*a*. Then, the locking pin 430 can be automatically aligned and inserted into the locking hole 420 of the slide rod 110*a* under the elastic force of the elastic member 410, as shown in FIG. 18 and FIG. 16, to enable re-locking of the body 100 with the bed frame 200.

Figure 19:
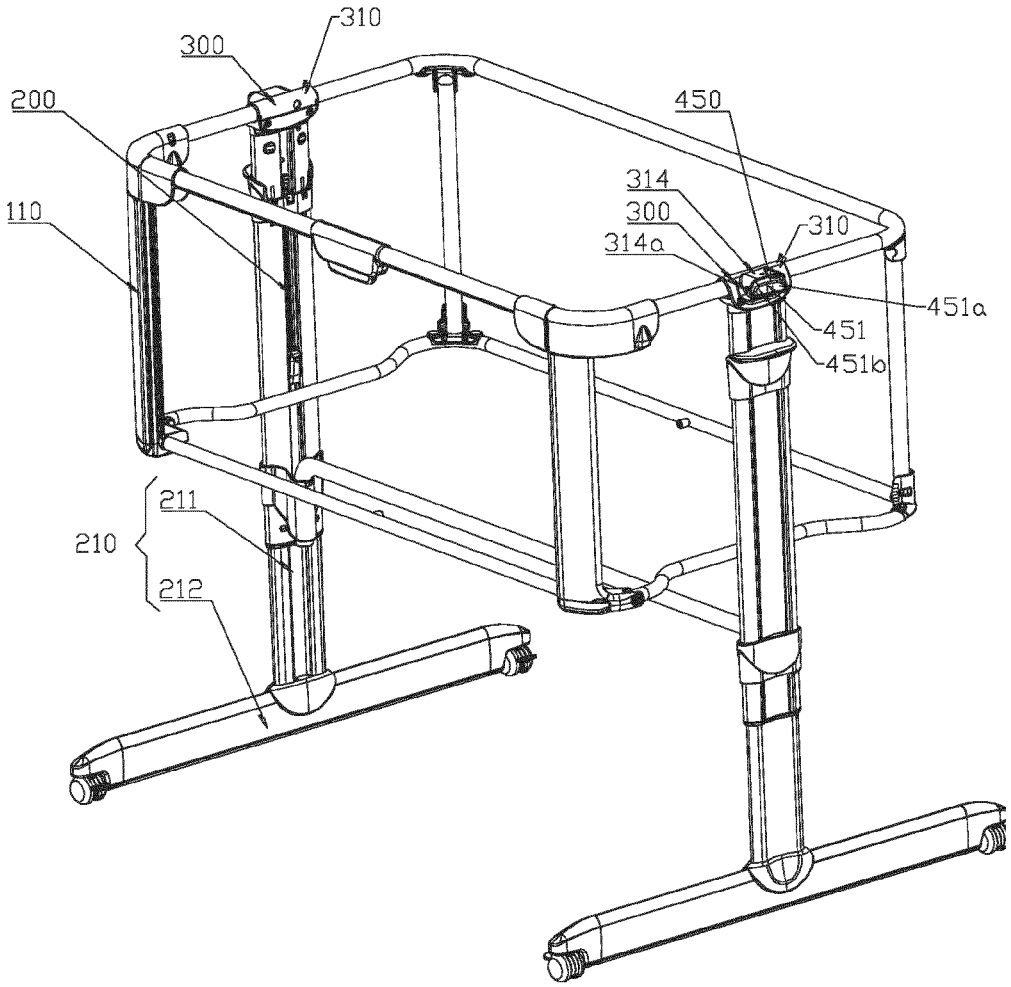
FIG. 19 is a schematic diagram of a crib according to another embodiment of the present disclosure, in which the first pressing end is pressed.
Figure 20:
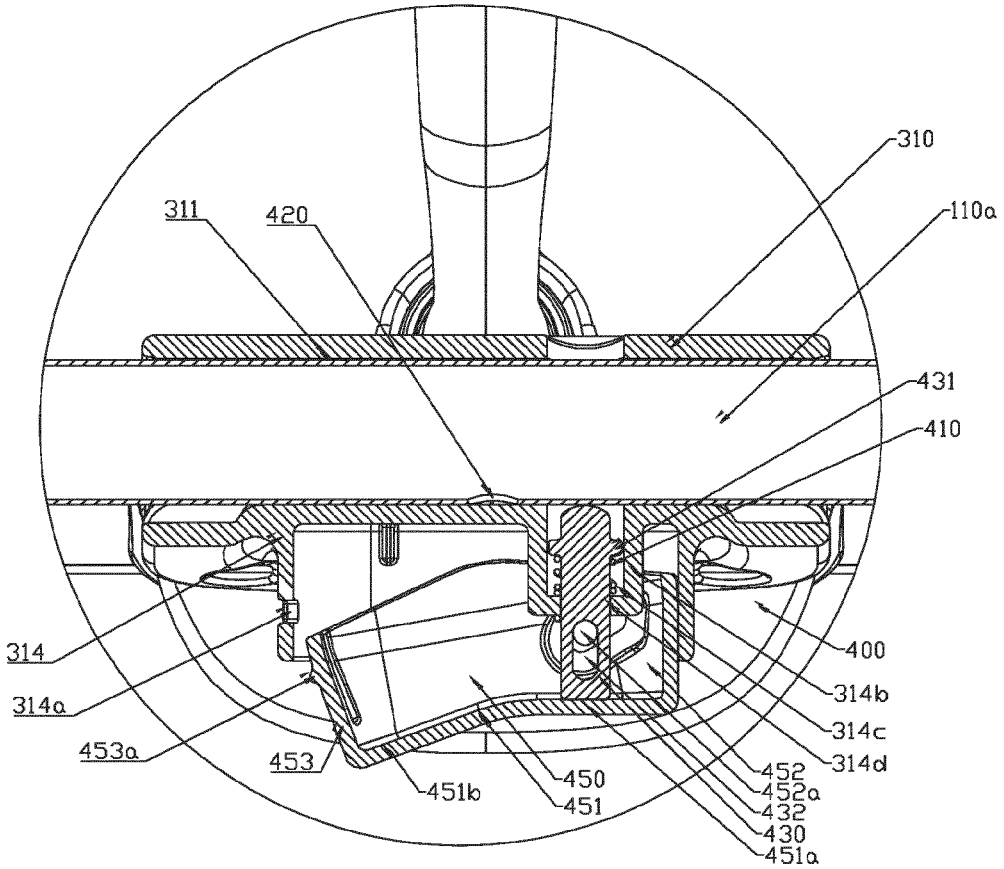
FIG. 20 is a partially sectional view of FIG. 19 with the locking pin not inserted into the locking hole.
Figure 21:
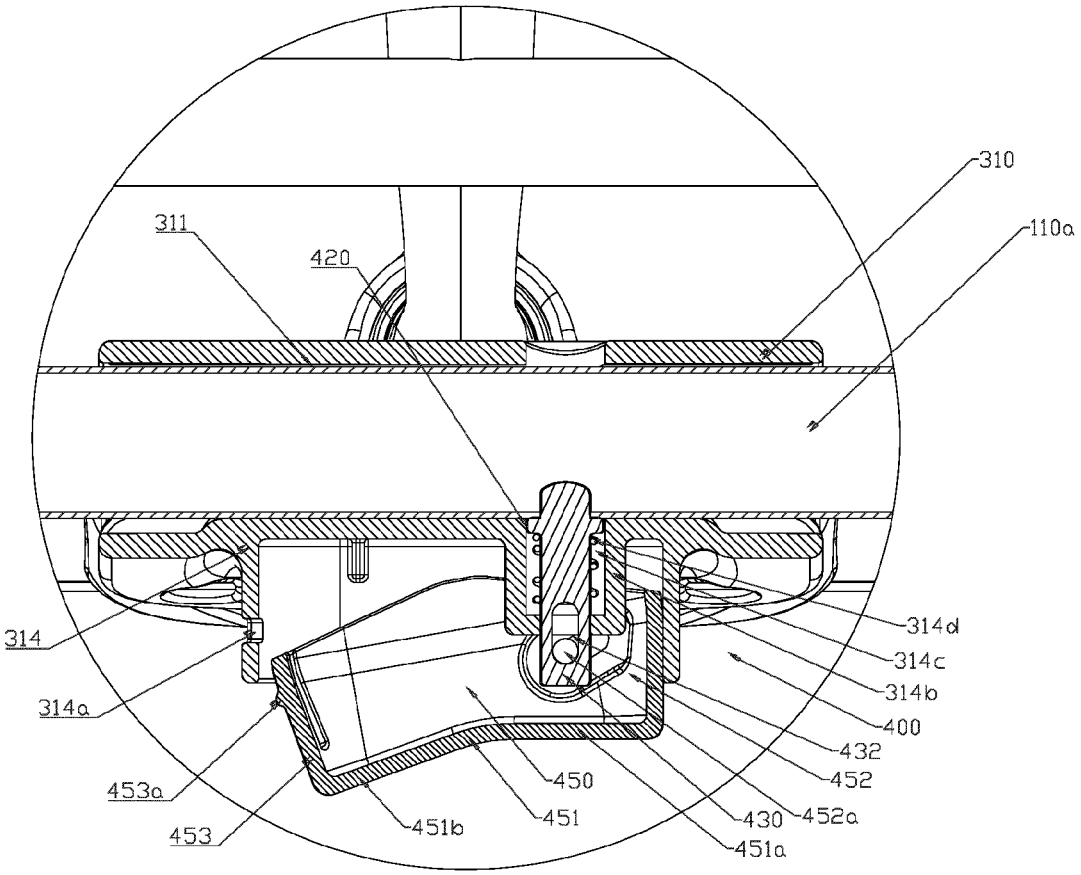
FIG. 21 is another partially sectional view of FIG. 19 with the locking pin inserted into the locking hole.
Figure 22:
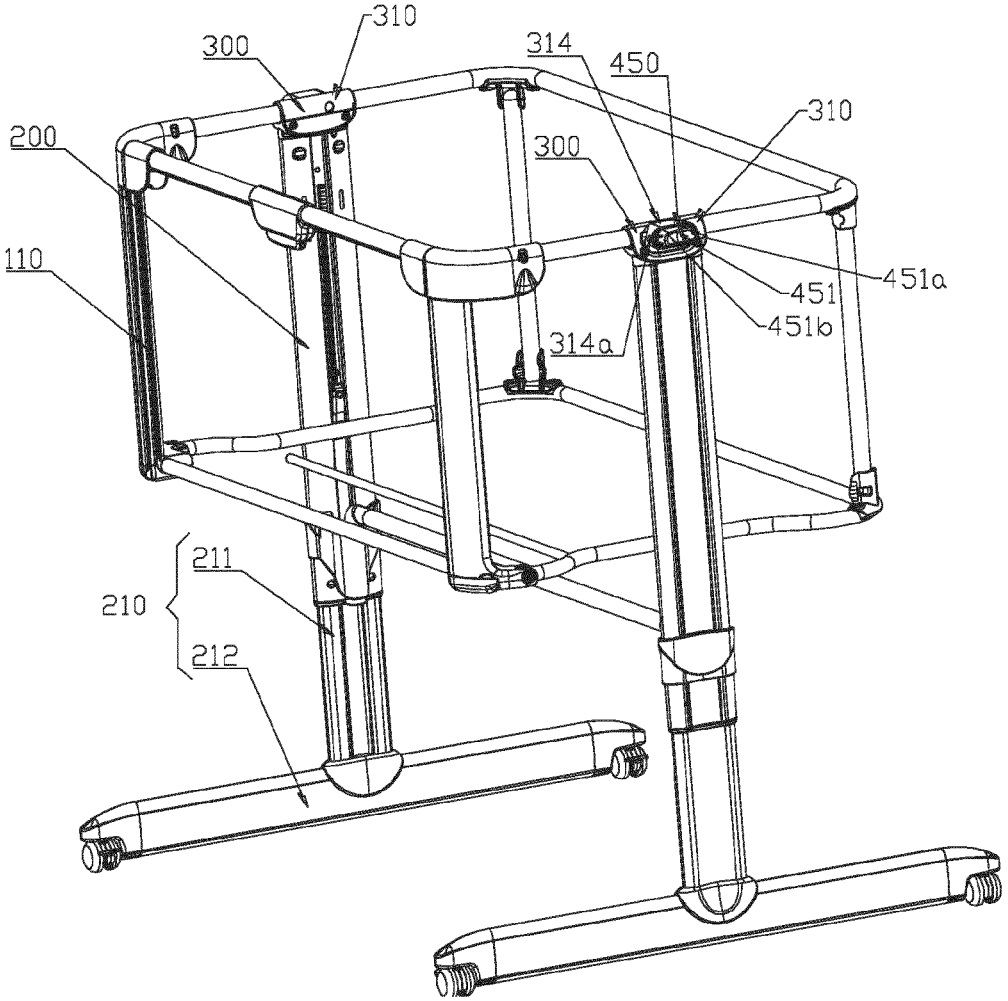
FIG. 22 is another schematic diagram of the crib according to another embodiment of the present disclosure, in which the second pressing end is pressed.

Also, for example, in another embodiment, as shown in FIGS. 19 to 23, the operating member may be a button 450, which has an elliptical cylindrical structure. The button 450 has a pressing surface 451 for applying force. The pressing surface 451 is a V-shaped surface. The pressing surface 451 has a first pressing end 451*a* and a second pressing end 451*b* bounded by a central recess of the V-shaped surface. The button 450 has a second mounting groove 452, and the locking pin 430 is partly disposed in the second mounting groove 452. A guide post 452*a* is disposed on the groove wall of the second mounting groove 452, and the locking pin 430 is provided with a guide slot 432 having a rectangular shape and disposed along an extension direction of the locking pin 430. The guide post 452*a* is inserted into the guide slot 432 such that the locking pin 430 can be moved relative to the button 450. Such setting enables connecting of the locking pin 430 to the button 450 and displacing of the locking pin 430 relative to the button 450 in a direction toward or away from the locking hole 420, as shown in FIGS. 20 and 21.

As shown in FIGS. 20 and 21, a mounting base 314 is disposed on the support base 300, the button 450 is movably disposed on the mounting base 314, and an end of the locking pin 430 away from the slide rod 110*a* is connected to the first pressing end 451*a*. When the first pressing end 451*a* is pressed, the first pressing end 451*a* is moved in a direction toward the locking hole 420 and the second pressing end 451*b* is moved in a direction away from the locking hole 420. When the second pressing end 451*b* is pressed, the second pressing end 451*b* is moved in a direction toward the locking hole 420, and the first pressing end 451*a* is moved in a direction away from the locking hole 420.

Figure 23:
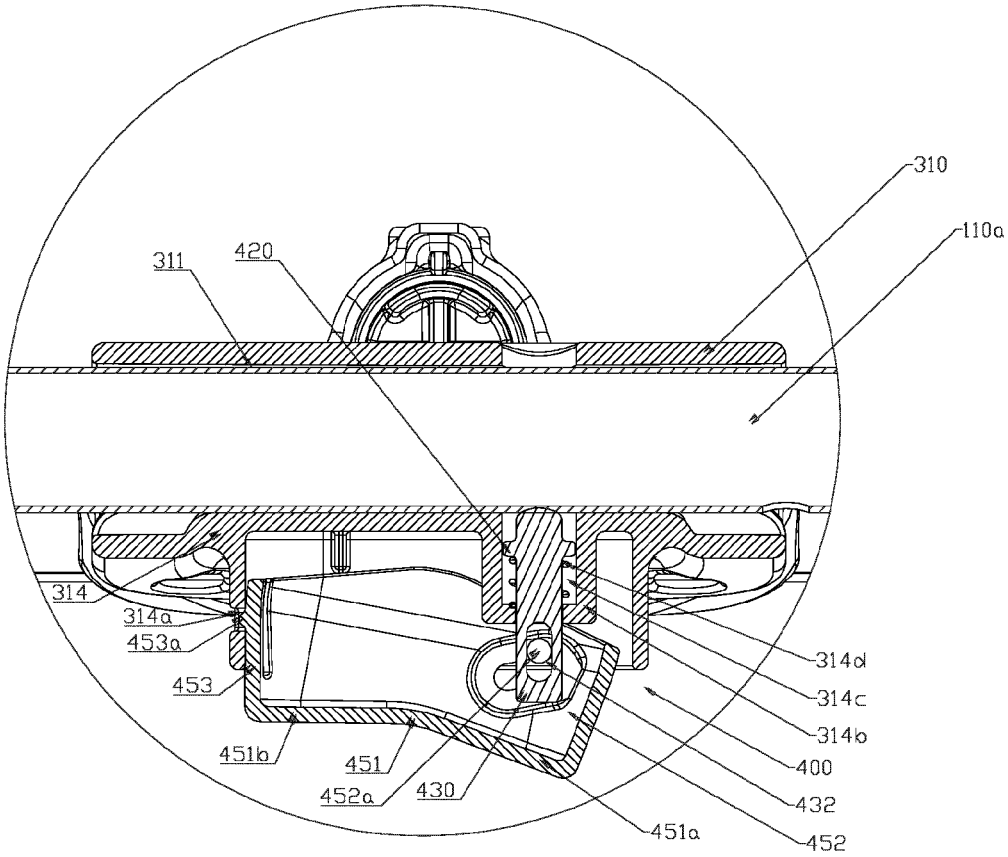
FIG. 23 is a partial sectional view of FIG. 22, with the locking pin not inserted into the locking hole.

Further, as shown in FIGS. 19 to 23, the mounting base 314 is provided with a first engaging portion, and a side of the button 450 close to the second pressing end 451*b* is provided with a second engaging portion. In this embodiment, the first engaging portion is an engaging hole 314*a*, and the second engaging portion is an engaging finger 453 provided with an engaging hook 453*a*. When the second pressing end 451*b* is pressed, the engaging hook 453*a* is inserted into the engaging hole 314*a*. In this way, when the pressing force is removed, the button 450 is capable of keeping the second pressing end 451*b* close to the locking hole 420 and the first pressing end 451*a* away from the locking hole 420, as shown in FIG. 23, that is, as long as the second pressing end 451*b* is pressed once, the locking mechanism 400 is kept in the unlocked state. When the first pressing end 451*a* is pressed, since the engaging finger 453 is capable of being elastically deformed to a certain extent, the engaging hook 453*a* is disengaged from the engaging hole 314*a*, as shown in FIGS. 20 and 21, thereby not intervening the locking of the locking mechanism 400.

Further, as shown in FIGS. 19 to 23, a second mounting protrusion 314*b* is disposed on the mounting base 314. The second mounting protrusion 314*b* has a receiving groove 314*c* in communication with the through passage 311. A second mounting hole 314*d* in communication with the receiving groove 314*c* is disposed on the middle portion of the second mounting protrusion 314*b*. The locking pin 430 movably extends through the second mounting hole 314*d*. The clastic member 410 is sleeved on the locking pin 430 such that two ends of the elastic member 410 abut on the abutting flange 431 and the bottom wall of the receiving groove 314*c* respectively. In this way, the elastic member 410 always moves the locking pin 430 in a direction toward the locking hole 420.

A specific operating principle of the locking mechanism 400 according to this embodiment is described as below.

In order to allow the body 100 to swing, the second pressing end 451*b* of the button 450 is pressed to be moved in a direction toward the locking hole 420, and at the same time, the first pressing end 451*a* is moved in a direction away from the locking hole 420, driving the locking pin 430 originally inserted into the locking hole 420 to be disengaged from the locking hole 420. The guide post 452*a* is moved to an end of the guide groove 432 away from the locking hole 420, as shown in FIG. 23. After the locking mechanism 400 is unlocked, the slide rod 110*a* is slidable relative to the support base 300, that is, pushing the body 100 allows the body 100 to swing relative to the bed frame 200. At the same time, the locking mechanism 400 is remained in the unlock state since the movement of the second pressing end 451*b* in the direction toward the locking hole 420 causes the engaging hook 453*a* on the engaging finger 453 to be inserted into the engaging hole 314*a* during the above-mentioned unlocking process.

In order to stop the swing of the body 100 and fix the body 100 relative to the bed frame 200, press the first pressing end 451*a* of the button 450 and then the second pressing end 451*b* is moved in a direction away from the locking hole 420, such that the engaging hook 453*a* on the engaging finger 453 is disengaged from the engaging hole 314*a*. The first pressing end 451*a* is then moved in the direction toward the locking hole 420. At the same time, the locking pin 430 is pushed in a direction toward the locking hole 420 and abuts on the slide rod 110*a*, and the clastic member 410 is compressed and deformed as shown in FIG. 19. Next, push and pull the body 100 such that the slide rod 110*a* is moved to make the support base 300 approximately in the middle portion of the slide rod 110*a* and the locking hole 420 is aligned with the second mounting hole 314*d*. At this time, the locking pin 430 can be automatically aligned and inserted into the locking hole 420 of the slide rod 110*a* under the clastic force of the elastic member 410, as shown in FIG. 21, to enable re-locking of the body 100 with the bed frame 200.

Figure 25:
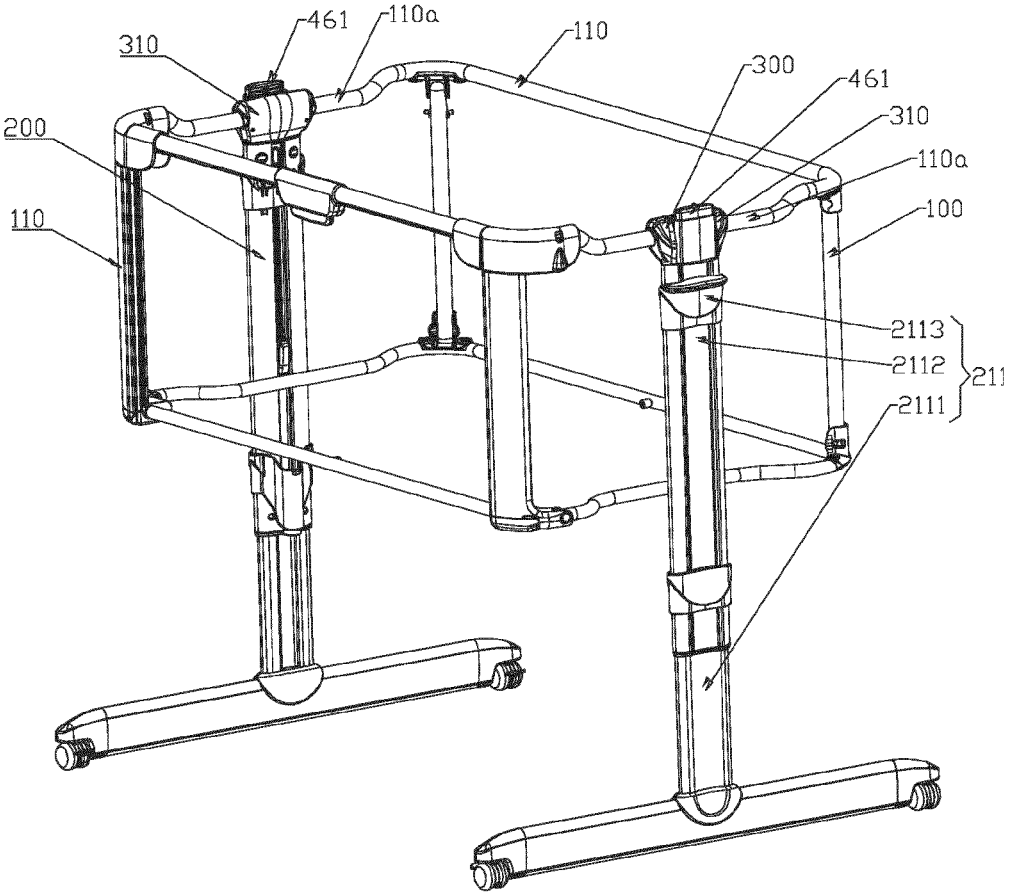
FIG. 25 is a schematic diagram of a crib according to another embodiment of the present disclosure.
Figure 29:
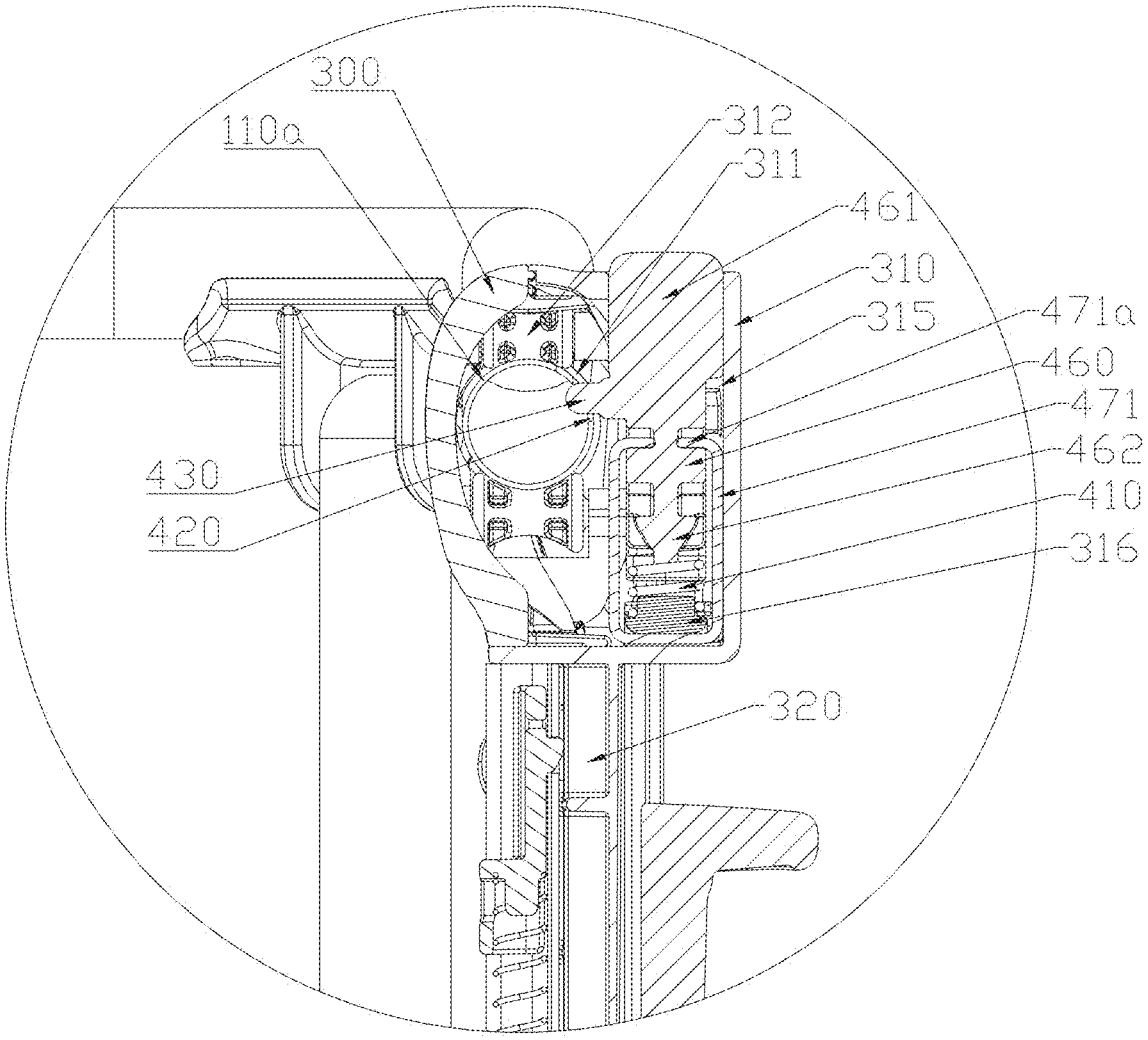
FIG. 29 is an enlarged view of portion F of FIG. 28.
Figure 30:
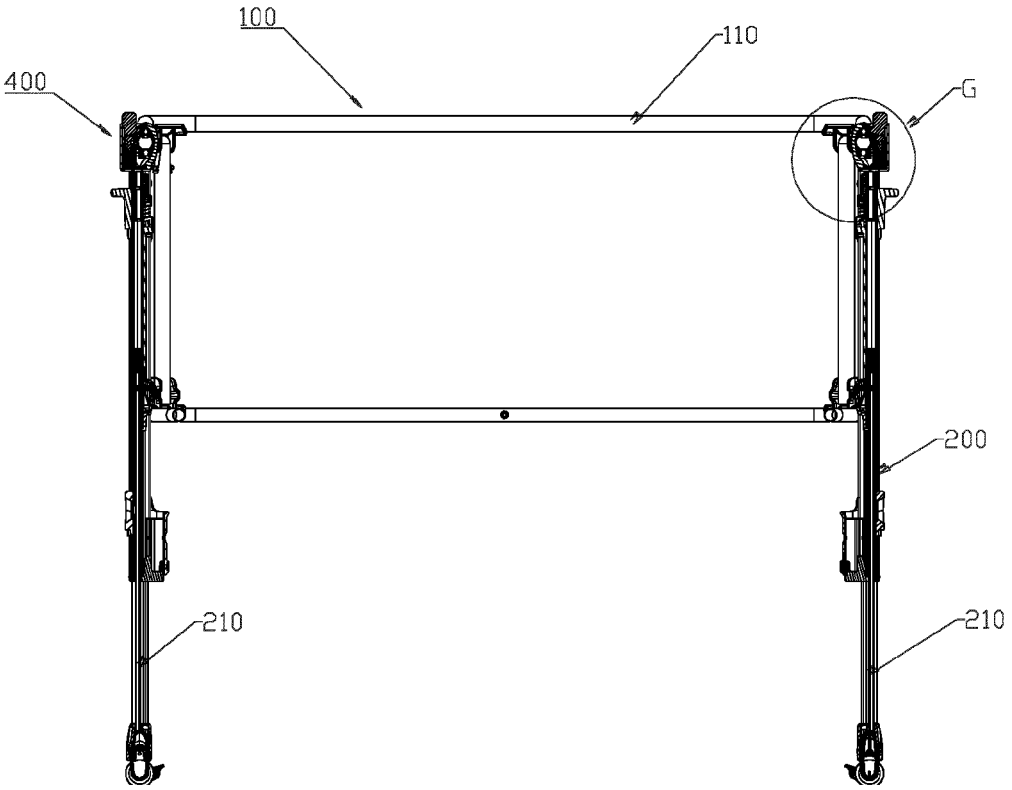
FIG. 30 is another sectional view of FIG. 25.

For example, in another embodiment, as shown in FIGS. 25 and 29, the operating member may be a pressing member 460, which has a substantially cylindrical structure. One end of the pressing member 460 is provided with a pressing portion 461, and the other end of the pressing member 460 is provided with an abutting protrusion 462. The locking pin 430 is fixed to one side of the pressing member 460 and is located between the pressing portion 461 and the abutting protrusion 462. In this embodiment, the locking pin 430 and the pressing member 460 are approximately perpendicular to each other. The mounting base 300 is provided with an assembly groove 315 in communication with the through passage 311, and the pressing member 460 is movably disposed in the assembly groove 315. The pressing portion 461 at least partially protrudes from the mounting base 300 to allow the caregiver to apply the pressing force conveniently, and a pressing direction of the pressing portion 461 is perpendicular to the extension direction of the locking pin 430.

Figure 15:
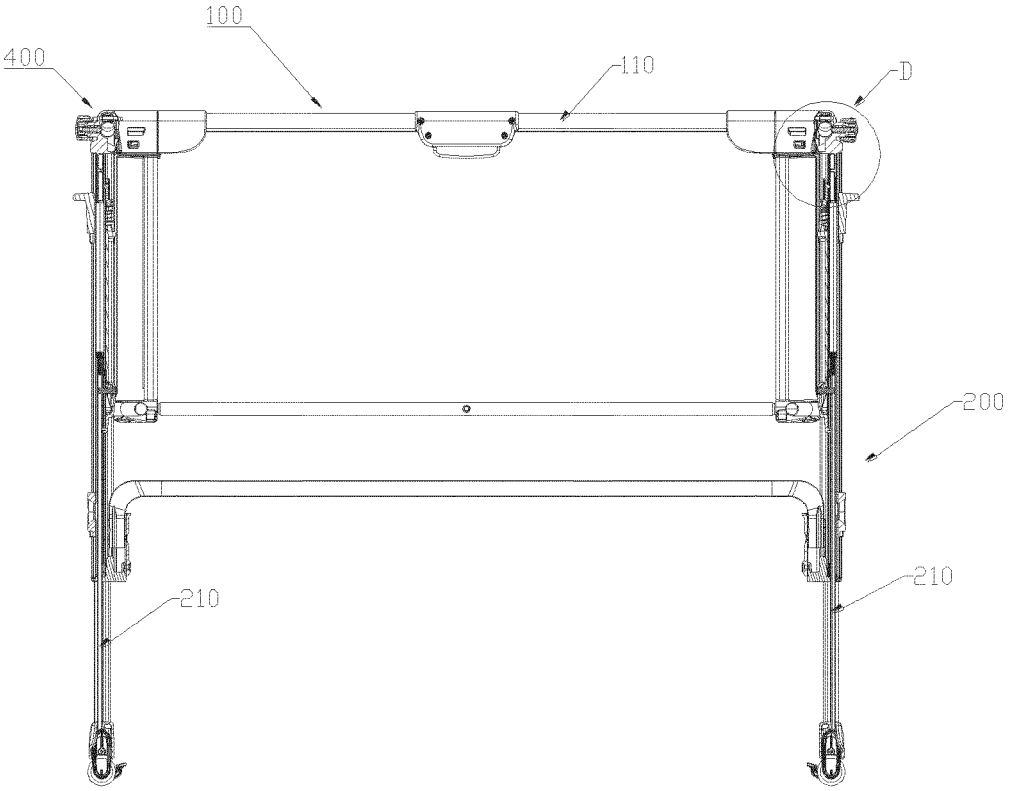
FIG. 15 is a sectional view of FIG. 1 with the locking pin inserted into the locking hole.
Figure 17:
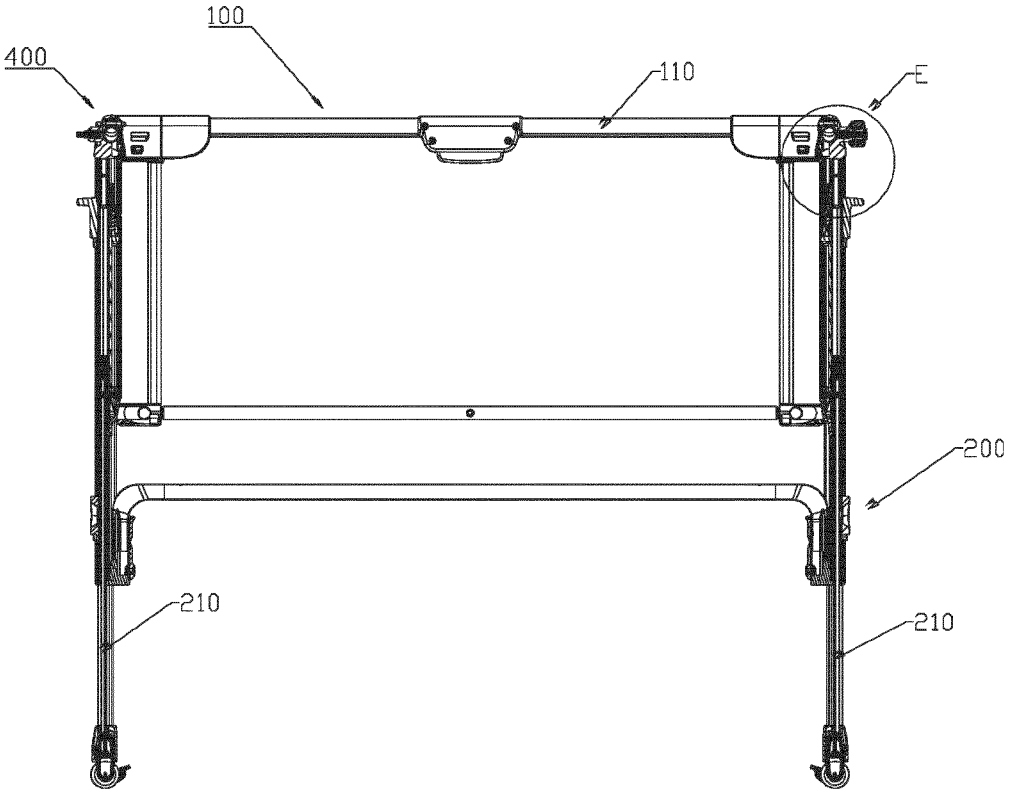
FIG. 17 is another sectional view of FIG. 1 with the locking pin not inserted into the locking hole.

Specifically, in this embodiment, the setting of the locking hole 420 is slightly different from that of the aforementioned two embodiments. In the aforementioned two embodiments, the knob 440 or the button 450 is operated to move the locking pin 430 toward or away from the locking hole 420 in a horizontal direction in FIG. 16 or the up-and-down direction in FIG. 20, so as to achieve insertion locking or unlocking with the locking hole 420. Therefore, the locking hole 420 is provided at the left side as shown in FIG. 15 or FIG. 17. In this embodiment, the pressing member 460 is operated such that the locking pin 430 is moved in a vertical direction in FIG. 29 toward or away from the locking hole 420, so as to achieve the insertion locking or unlocking with the locking hole 420, such that the locking hole 420 is provided at an upper left side as shown in FIG. 29, such that when the pressing member 460 is pressed down, and the locking pin 430 is moved downward, the locking pin 430 is not blocked by the rod wall of the slide rod 110*a*, thus the locking pin 430 can be inserted into the locking hole 420 smoothly.

Figure 31:
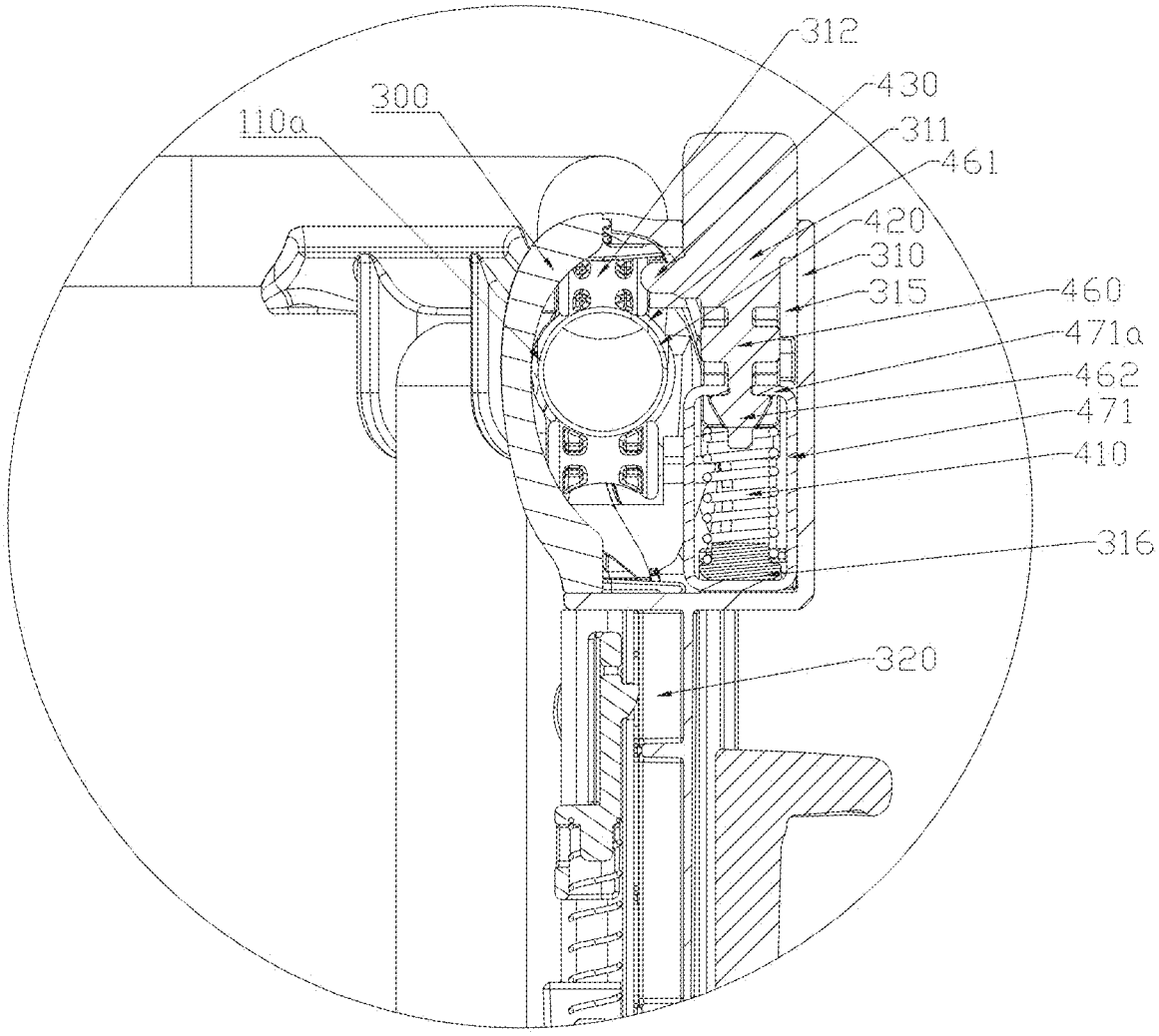
FIG. 31 is an enlarged view of portion G of FIG. 30.
Figure 32:
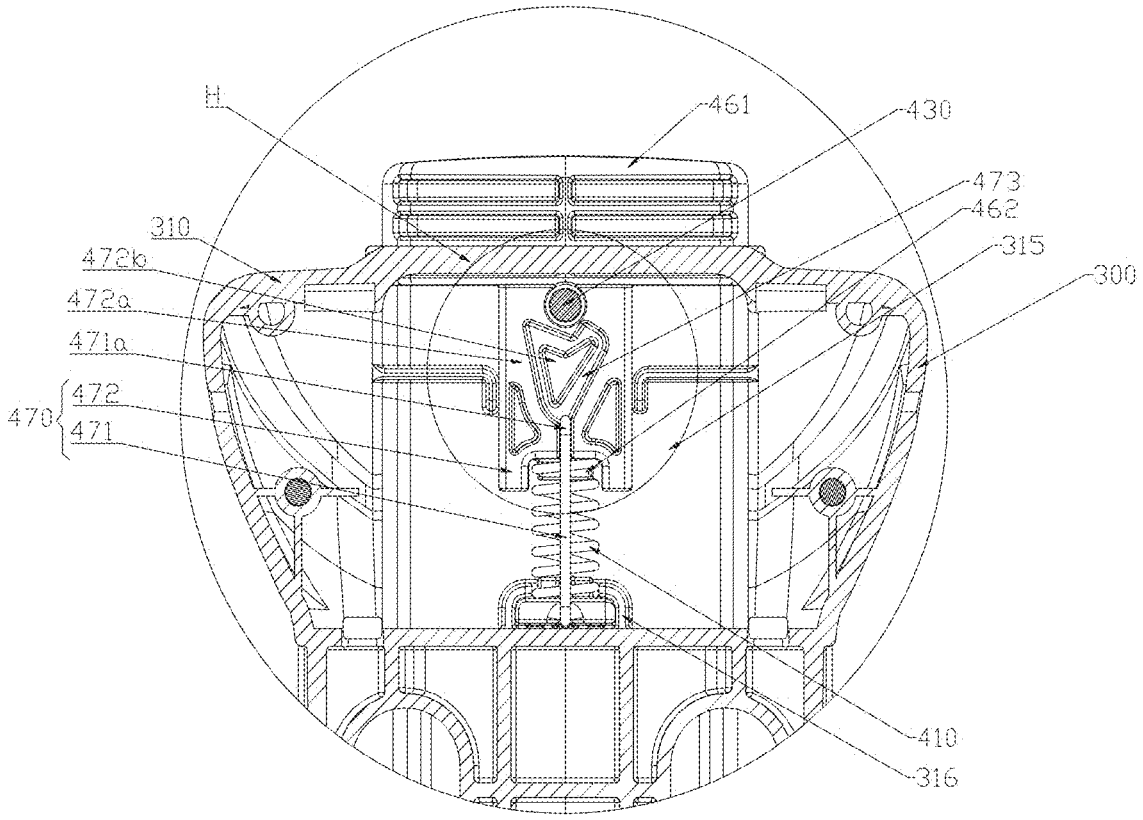
FIG. 32 is a sectional view of FIG. 25 in another direction.

Further, as shown in FIGS. 29 and 31, a base 316 is provided in the support base 300 close to the bottom portion thereof, and two ends of the elastic member 410 abut on the base 316 and the abutting protrusion 462 respectively. In this way, the clastic member 410 constantly moves the abutting protrusion 462 upward, that is, constantly moves the locking pin 430 toward the unlocked position.

Further, as shown in FIGS. 22 to 35, the locking mechanism 400 further includes a holding assembly 470. When the pressing member 460 is in the locked position, the holding assembly 470 keeps the pressing member 460 in the locked position. Specifically, the hold assembly 470 includes a holding frame 471 and a holding member 472. The holding frame 471 is approximately a square frame (shown in FIGS. 29 and 31). The bottom portion of the holding frame 471 is rotated and attached to the base 316, and a top portion of the holding frame 471 (i.e., an end away from the base 316) is disconnected in the middle, forming two opposing snap portions 471*a*. The two snap portions 471*a* are snapped on both sides of the holding member 472. Of course, in other embodiments, there may be only one snap portion 471*a* to snap the holding member 472.

As shown in FIGS. 32 to 35, the holding member 472 is fixed to the pressing member 460. The holding member 472 and the pressing member 460 may be integrally formed or may be two separate components. The holding member 472 includes a holding body 472*a* and a limit block 472*b* fixed to the holding body 472*a*. The holding body 472*a* and the limit block 472*b* may be integrally formed or may be two separate components. A side of the limit block 472*b* close to the pressing portion 461 has a first limit projection 472*c* and a second limit projection 472*d*, and the first limit projection 472*c* and the second limit projection 472*d* enclose to form a limit slot 472*c*. A guide passage 473 in communication with the limit slot 472*e* is formed between the limit block 472*b* and the holding body 472*a*, and the snap portion 471*a* can be moved along the guide passage 473. When the pressing member 460 is moved from the unlocked position to the locked position, the snap portion 471*a* is moved along the guide passage 473 and into the limit slot 472*e* by passing the first limit projection 472*c*. When the pressing member 460 is moved from the locked position to the unlocked position, the snap portion 471*a* is moved along the guide passage 473 and is disengaged from the limit slot 472*e* by passing the second limit projection 472*d*. This allows the holding assembly 470 to hold the pressing member 460 in the locked position.

Figure 33:
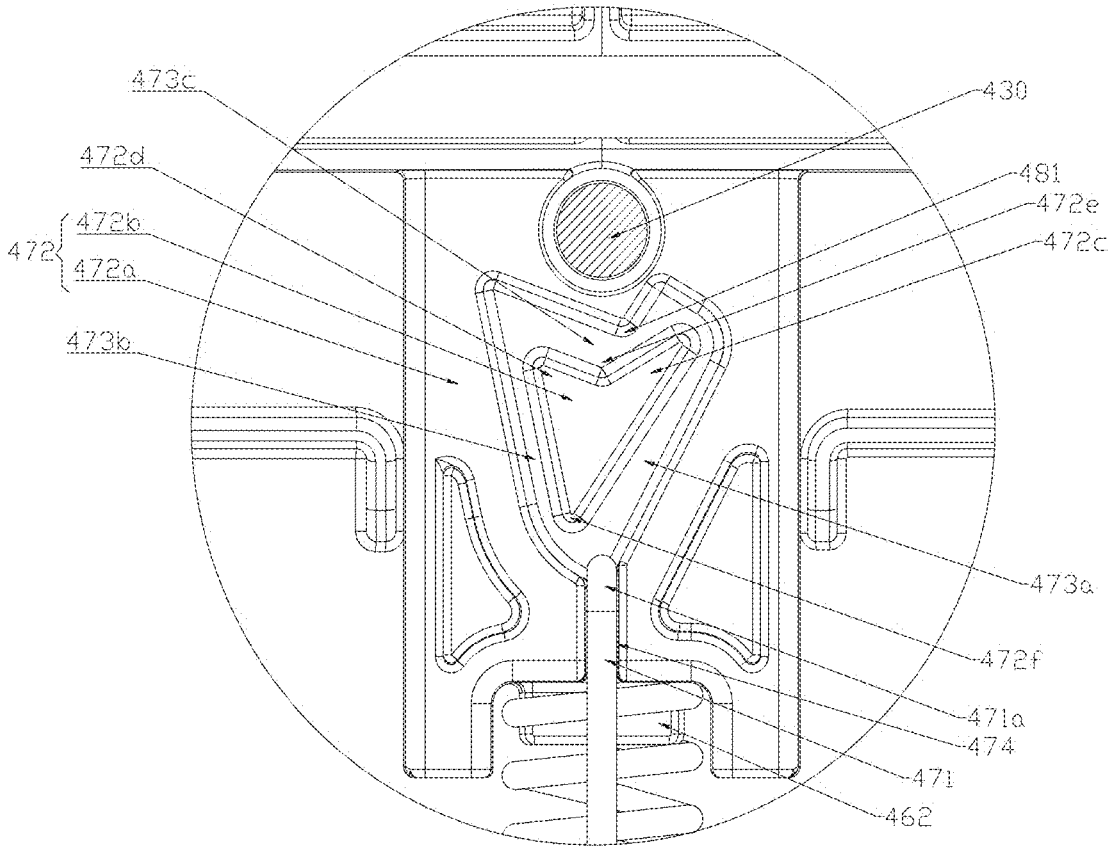
FIG. 33 is an enlarged view of portion H of FIG. 32.
Figure 34:
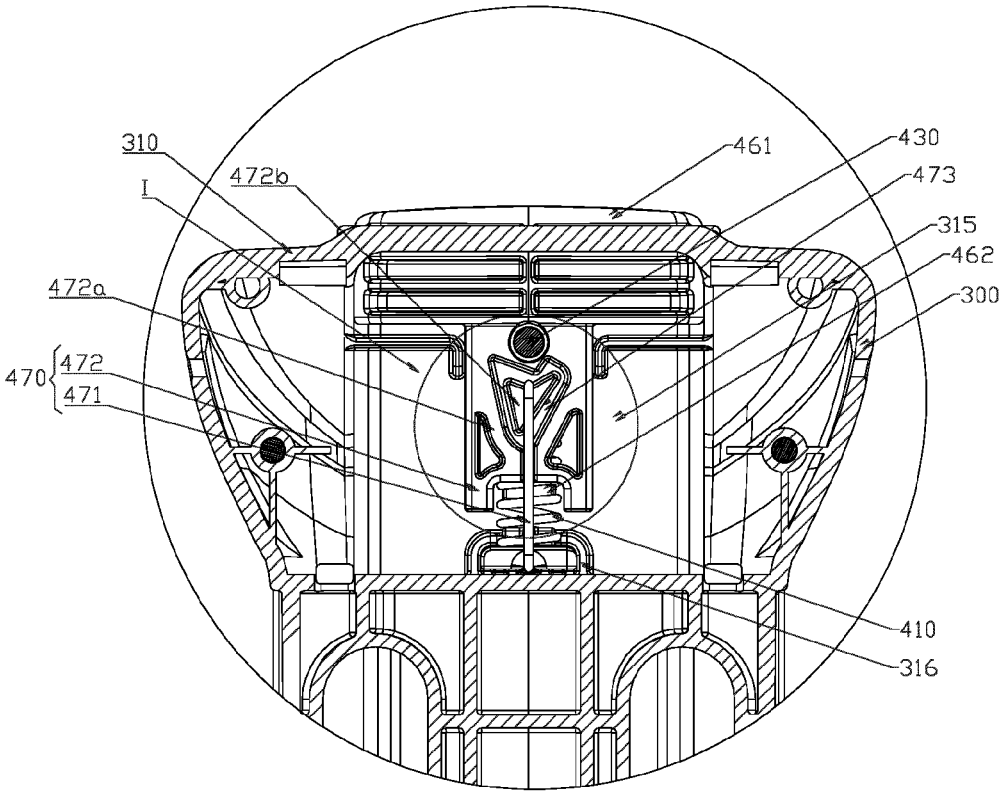
FIG. 34 is another sectional view of FIG. 25 in another direction.
Figure 35:
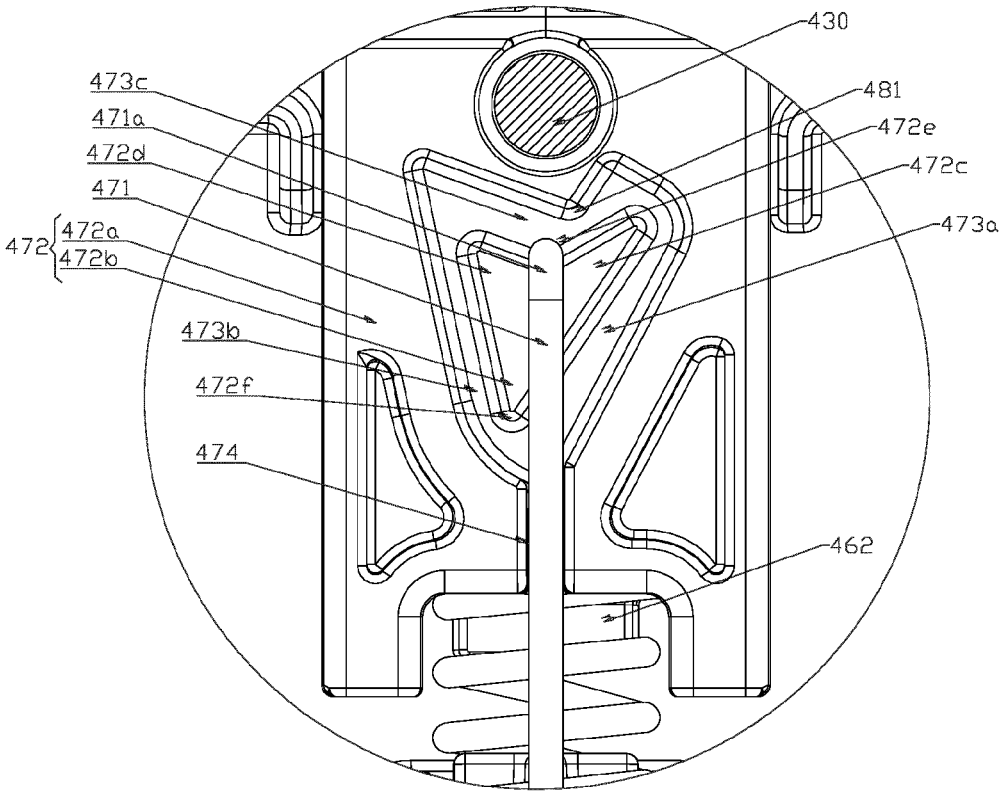
FIG. 35 is an enlarged view of portion I of FIG. 34.

Specifically, as shown in FIGS. 32 to 35, the limit block 472*b* has an approximately inverted triangular block structure. The guide channel 473 is substantially divided into a first passage 473*a*, a second passage 473*b*, and a third passage 473*c*, which intercommunicates with each other and are arranged along three sides of a triangle. The limit slot 472*e* is located in the third passage 473*c*. The first passage 473*a* and the first limit projection 472*c* are located on the relative left side, and the second passage 473*b* and the second limit projection 472*d* are located on the relative right side. The holding body 472*a* is also provided with a receiving passage 474 located below the limit block 472*b*, the receiving passage 474 is arranged in a vertical direction, and the receiving passage 474 is in communication with the first passage 473*a* and the second passage 473*b*. A bottom corner 472*f* of the limit block 472*b* is biased toward the second passage 473*b*. The holding body 472*a* is provided with a limit projection 481 which is biased toward the first limit projection 472*c*. When the pressing member 460 is pressed and moved from the unlocked position to the locked position, due to the blocking of the bottom angle 472*f* of the limit block 472*b*, the snap portion 471*a* located in the receiving passage 474 is moved obliquely upward along the first passage 473*a* and enters the limit slot 472*e* by passing the first limit projection 472*c*, as shown in FIG. 35. At this time, the snap portion 471*a* is confined between the first limit projection 472*c* and the second limit projection 472*d*, such that after the pressing force applied to the pressing member 460 is withdrawn, the pressing member 460 is not moved upward under the action of the elastic member 410, that is, the pressing member 460 remains at the locked position. When the pressing member 460 is pressed again, due to the blocking of the limit projection 481, the snap portion 471*a* located in the limit slot 472*e* is disengaged from the limit slot 472*e* and is moved into the second passage 473*b* by passing the second limit projection 472*d* along the third passage 473*c*, and is moved back to the receiving passage 474 diagonally along the second passage 473*b*, as shown in FIG. 33, so as to allow the pressing member 460 to be moved from the locked position to the unlocked position under the clastic force of the elastic member 410.

A specific operating principle of the locking mechanism 400 according to this embodiment is described as below.

Figure 26:
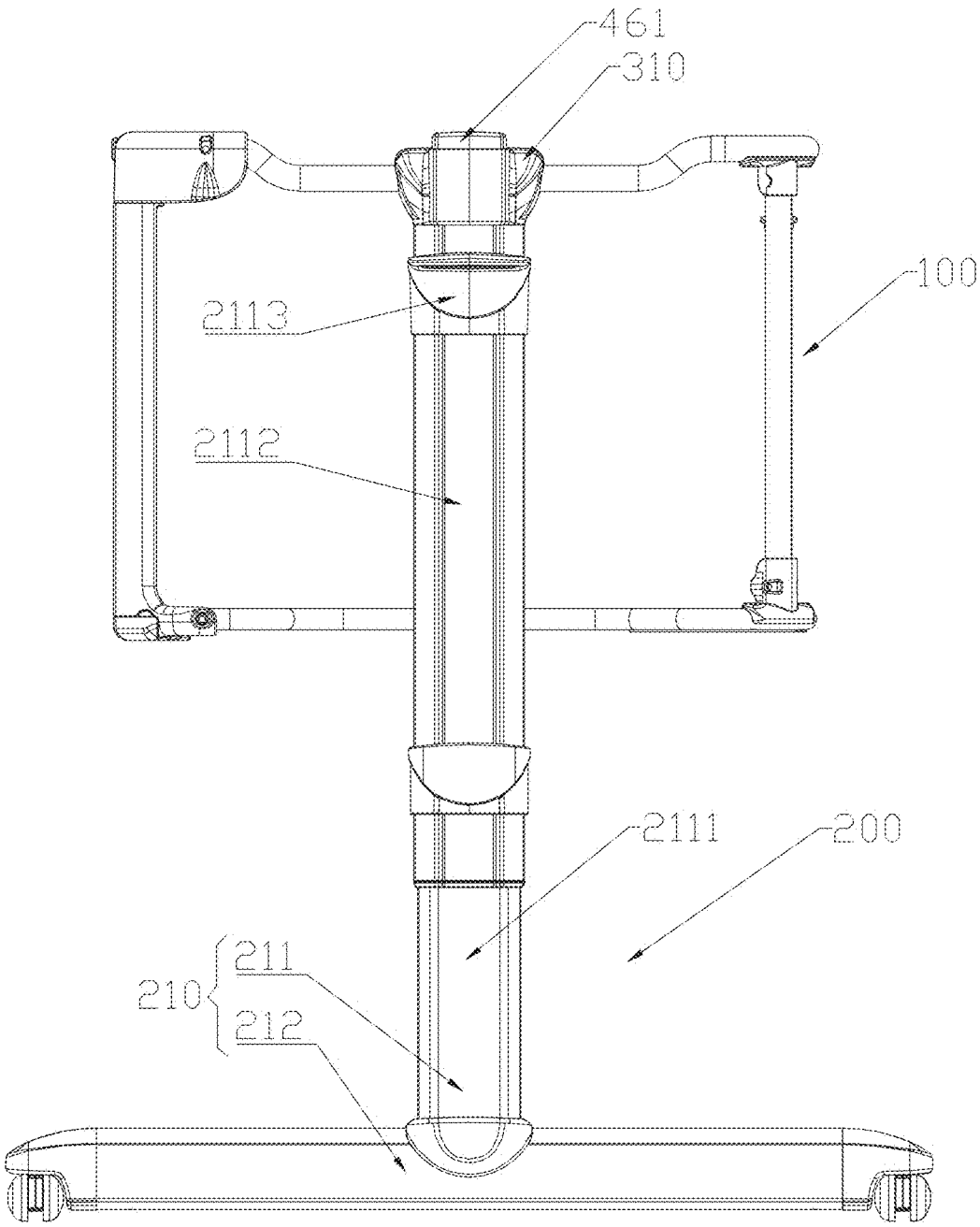
FIG. 26 is a side view of FIG. 25, with the pressing member in an unlocked state.

In order to allow the body 100 to swing, press the pressing member 460 such that the snap portion 471*a* located in the limit slot 472*e* is disengaged from the limit slot 472*e* and is moved into the second passage 473*b* by passing the second limit projection 472*d* along the third passage 473*c*, and is moved back to the receiving passage 474 diagonally along the second passage 473*b*, as shown in FIG. 33, that is, if the holding action of the holding mechanism 400 is withdrawn, the pressing member 460 is capable of being moved from the locked position to the unlocked position under the elastic force of the elastic member 410, that is, the pressing member 460 is moved upward such that the locking pin 430 is disengaged from the locking hole 420, as shown in FIGS. 26 and 31.

Figure 27:
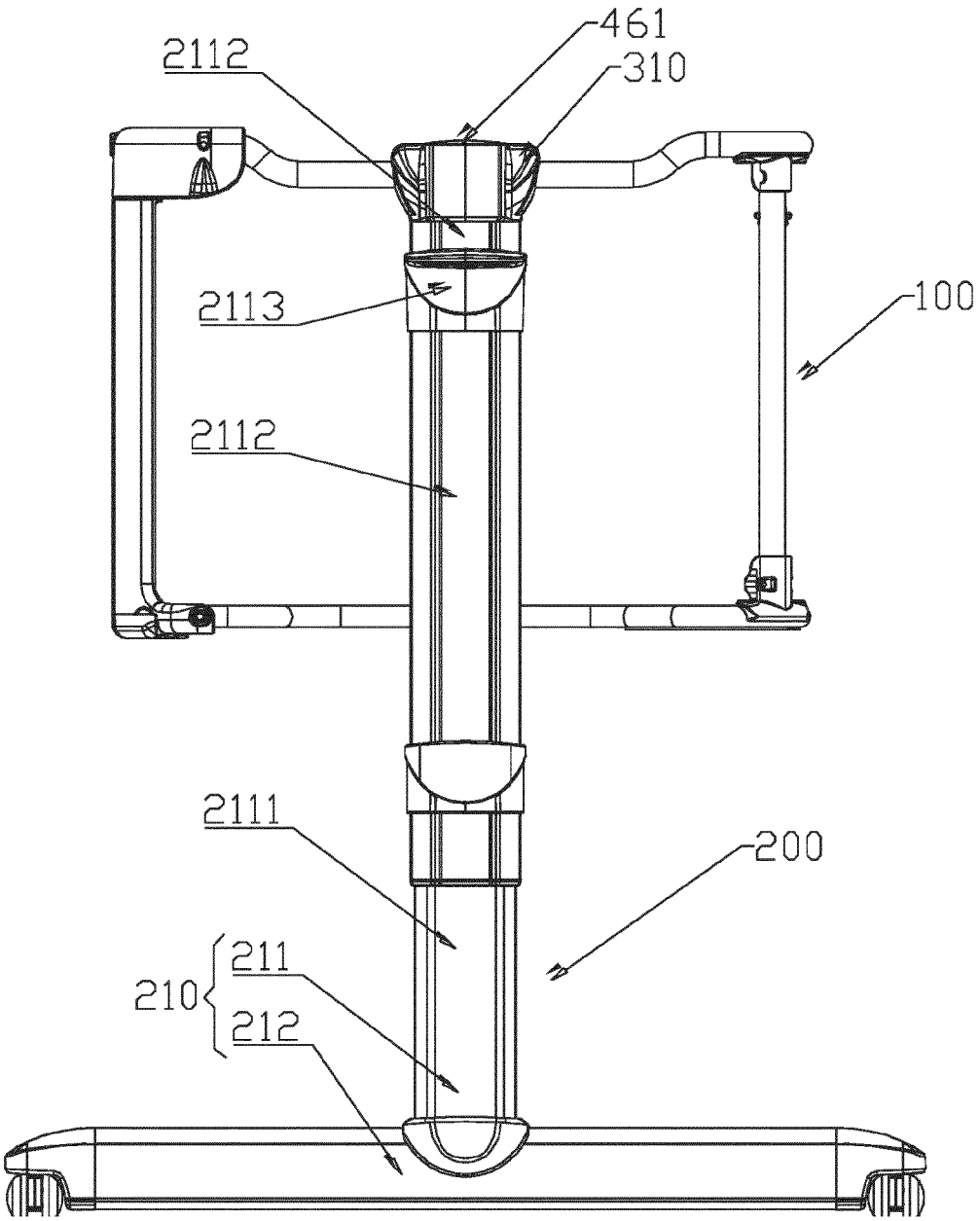
FIG. 27 is another side view of FIG. 25, in which the pressing member is in a locked state.
Figure 28:
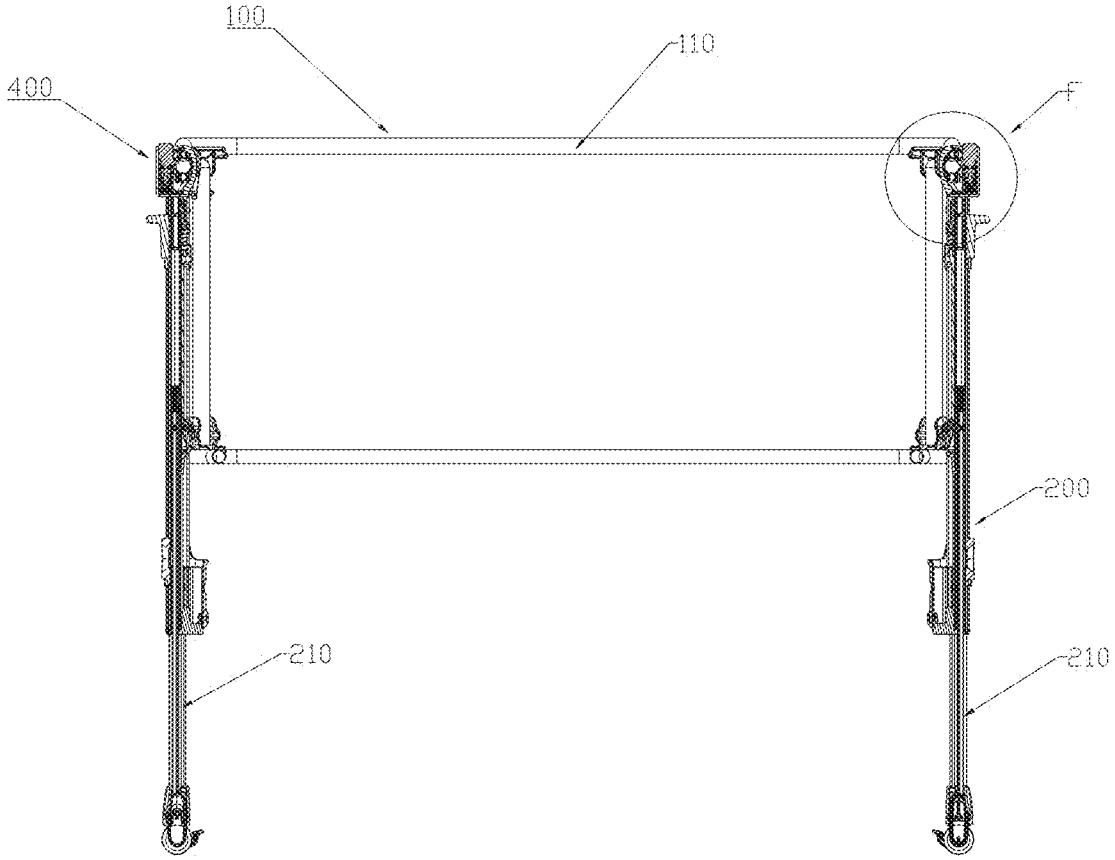
FIG. 28 is a sectional view of FIG. 25.

In order to stop the swing of the body 100 and fix the body 100 relative to the bed frame 200, the pressing member 460 can be pressed again such that the pressing member 460 is moved from the unlocked position to the locked position, that is, the pressing member 460 is moved downward such that the locking pin 430 is inserted into the locking hole 420, as shown in FIGS. 27 and 29. At the same time, the snap portion 471*a* located in the receiving passage 474 is moved obliquely upwards along the first passage 473*a* and is moved into the limit slot 472*e* by passing the first limit protrusion 472*c*, such that the pressing member 460 remains at the locked position, as shown in FIG. 35.

It should be noted that in the three embodiments described above, the two slide rods 110*a* on the opposite sides of the body 100 and the support base 300 on the two support posts 210 can be locked or unlocked simultaneously by the corresponding locking mechanism 400, or can be locked or unlocked respectively by the corresponding locking mechanism 400. For example, the slide rod 110*a* on one side is slidable relative to the support base 300, and the slide rod 110*a* on the other side is fixed relative to the support base 300, that is, the swing of one side can be achieved.

The aforementioned crib has at least the following technical effects.

In the crib, the body 100 has an accommodation space for a child to sleep or play therein, which is supported by the bed frame 200, and which extends through the through passage 311 of the support base 300 disposed on the bed frame 200 via the slide rod 110*a*, so as to realize a slide connection between the slide rod 110*a* and the support base 300, that is, a slide connection between the body 100 and the bed frame 200. In this way, the swing of the body 100 relative to the bed frame 200 can be realized by pushing and pulling the body 100 back and forth, which acts as a comfort to the child in the body 100. The crib has a simple structure to realize the swing function of the body, and it is easy to operate.

The technical features of the aforementioned embodiments may be arbitrarily combined, and in order to make the description concise, not all possible combinations of the technical features in the aforementioned embodiments are described. However, as long as there is no contradiction in the combination of these technical features, it should be considered as the scope of this specification.

The embodiments described above express only a few embodiments of the present disclosure, which are described more specifically and in more detail, but are not thereby understood as limiting the scope of the invention patent. It should be noted that, for those ordinary skilled in the art, a plurality of modifications and improvements may be made without departing from the concept of the present disclosure, which all fall within the scope of protection of the present disclosure. Therefore, the protection scope of the invention patent shall be subject to the attached claims.

The invention claimed is:

1. A crib, comprising:

a body having an accommodation space configured to accommodate a child and comprising a slide rod;

a bed frame configured to support the body; and a support base fixed to the bed frame, wherein the slide rod extends through the support base and is slidable relative to the support base, and wherein the support base is further provided with a roller abutting on the slide rod.

2. The crib according to claim 1, further comprising a locking mechanism, wherein the body is fixed relative to the support base when the locking mechanism is in a locked state, and the body is slidable relative to the support base when the locking mechanism is in an unlocked state.

3. The crib according to claim 2, wherein the locking mechanism comprises a first locking portion disposed on the slide rod and a second locking portion disposed on the support base, the second locking portion is operatable to be engaged with or disengaged from the first locking portion, such that the locking mechanism is in the locked state or the unlocked state.

4. The crib according to claim 3, wherein the support base has a through passage, the slide rod extends through the through passage, the first locking portion is a locking hole disposed on the slide rod, and the second locking portion is a locking pin disposed on the support base, the locking pin being insertable into the locking hole.

5. The crib according to claim 4, wherein the locking mechanism further comprises an operating member operatable to move the locking pin in a direction toward or away from the locking hole.

6. The crib according to claim 5, wherein the operating member is a knob provided with a driving rib, the support base is provided with a driving inclined surface cooperating with the driving rib, and the knob is rotatable such that the driving rib is moved along the driving inclined surface to move the locking pin in a direction toward or away from the locking hole.

7. The crib according to claim 6, wherein the driving inclined surface is provided with a first stop position and a second stop position, the locking pin is disengaged from the locking hole when the driving rib is moved to the first stop position, and the locking pin is inserted into and engaged with the locking hole when the driving rib is moved to the second stop position.

8. The crib according to claim 6, wherein the support base is provided with a first mounting protrusion provided with a first mounting hole in communication with the locking hole, the locking pin movably extends through the first mounting hole, the driving inclined surface is disposed on a side wall of the first mounting protrusion, the knob has a first mounting groove, the driving rib is disposed on a side wall of the first mounting groove, the knob is rotatably disposed on the first mounting protrusion such that all or part of the first mounting protrusion is accommodated in the first mounting groove, and a bottom wall of the first mounting groove is connected to an end of the locking pin away from the locking hole.

9. The crib according to claim 5, wherein the operating member is a button having a first pressing end and a second pressing end, the locking pin is capable of being inserted into and engaged with the locking hole when the first pressing end is pressed, and the locking pin is capable of being disengaged from the locking hole when the second pressing end is pressed.

10. The crib according to claim 9, wherein the support base is provided with a mounting base, the button is movably disposed on the mounting base, and an end of the locking pin away from the locking hole is connected to the first pressing end;

wherein when the first pressing end is pressed, the first pressing end is moved in a direction toward the locking hole and the second pressing end is moved in a direction away from the locking hole; and wherein when the second pressing end is pressed, the second pressing end is moved in a direction toward the locking hole and the first pressing end is moved in a direction away from the locking hole.

11. The crib according to claim 10, wherein the mounting base is provided with a first engaging portion, a side of the button close to the second pressing end is provided with a second engaging portion, the second engaging portion is engaged with the first engaging portion when the second pressing end is pressed, and the second engaging portion is disengaged from the first engaging portion when the first pressing end is pressed.

12. The crib according to claim 4, wherein the locking mechanism further comprises a pressing member having an unlocked position and a locked position, the locking pin is capable of being inserted into and engaged with the locking hole when the pressing member is in the locked position, the locking pin is capable of being disengaged from the locking hole when the pressing member is in the unlocked position, and the pressing member is capable of being pressed to switch between the locked position and the unlocked position.

13. The crib according to claim 12, wherein an assembly groove in communication with the through passage is disposed on the support base, the pressing member is movably disposed in the assembly groove, the pressing member has a pressing portion at least partially protruding from the support base, the locking pin is fixed to the pressing member, and a pressing direction of the pressing portion is staggered with an extension direction of the locking pin.

14. The crib according to claim 13, wherein the locking mechanism further comprises an elastic member that constantly moves the locking pin toward the unlocked position.

15. The crib according to claim 14, wherein a base is provided in the support base, an abutting protrusion is provided at an end of the pressing member away from the pressing portion, and two ends of the elastic member abut on the base and the abutting protrusion respectively.

16. The crib according to claim 1, wherein there are at least two rollers, and at least two opposite sides of the slide rod abut on the rollers.

17. The crib according to claim 1, wherein both opposite sides of the body are provided with the slide rod, the bed frame comprises support posts on opposite sides of the bed frame, both the support posts are fixed to two said support bases respectively, and the slide rods on the opposite sides of the body extend through the support bases on the opposite sides of the bed frame respectively.

18. The crib according to claim 17, wherein the support post is height adjustable.

19. The crib according to claim 18, wherein the support post comprises a first socket rod, a second socket rod and a height adjustment handle, the first socket rod is partially inserted into the second socket rod, and the height adjustment handle is operatable such that the first socket rod is fixed or slidable relative to the second socket rod.

* * * * *